US008066539B2

(12) United States Patent
Suzuki et al.

(10) Patent No.: US 8,066,539 B2
(45) Date of Patent: Nov. 29, 2011

(54) MARINE PROPULSION SYSTEM

(75) Inventors: Takayoshi Suzuki, Shizuoka (JP); Daisuke Nakamura, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 145 days.

(21) Appl. No.: 12/372,794

(22) Filed: Feb. 18, 2009

(65) Prior Publication Data

US 2009/0209151 A1 Aug. 20, 2009

(30) Foreign Application Priority Data

Feb. 18, 2008 (JP) ..... 2008-036231

(51) Int. Cl.
*B60W 10/04* (2006.01)
*B63H 21/21* (2006.01)

(52) U.S. Cl. ..... 440/86

(58) Field of Classification Search ..... 440/1, 49, 440/75, 80, 81, 84, 86, 87; 701/1, 21, 51–56
See application file for complete search history.

(56) References Cited

U.S. PATENT DOCUMENTS

| | | | | |
|---|---|---|---|---|
| 5,711,742 | A | 1/1998 | Leinonen et al. | |
| 5,888,108 | A | 3/1999 | Iriono | |
| 6,582,259 | B1 * | 6/2003 | Mansson et al. | 440/75 |
| 7,458,866 | B2 * | 12/2008 | Nakamura et al. | 440/75 |
| 7,524,222 | B2 * | 4/2009 | Ochiai | 440/84 |
| 7,762,858 | B2 * | 7/2010 | Suzuki et al. | 440/1 |

FOREIGN PATENT DOCUMENTS

JP 09-263294 A 10/1997

* cited by examiner

*Primary Examiner* — Daniel Venne
(74) *Attorney, Agent, or Firm* — Keating & Bennett, LLP

(57) ABSTRACT

A marine propulsion system includes a transmission mechanism arranged to transmit a driving force generated by an engine to propellers with a speed thereof changed to a low speed reduction ratio and a high speed reduction ratio; a control lever section operated by a user in controlling drive of the engine; and a control portion and an ECU controlling a shift between reduction ratios of the transmission mechanism based on operation of the control lever section by the user. The control portion and the ECU control a shift between reduction ratios of the transmission mechanism based on a transmission control map providing a reference for a shift between reduction ratios of the transmission mechanism taking into consideration an engine speed of the engine and a lever opening of the control lever section. This arrangement provides a marine propulsion system in which both acceleration performance and maximum speed can approach levels that a user desires.

11 Claims, 12 Drawing Sheets

Timing chart corresponding to locus P3

MARINE PROPULSION SYSTEM

BACKGROUND OF THE INVENTION

1. Field of the Invention

The present invention relates to marine propulsion systems, in particular, the present invention relates to a marine propulsion system including an engine.

2. Description of the Related Art

Conventionally, marine propulsion units (marine propulsion systems) including an engine are known (for example, see JP-A-Hei 9-263294). JP-A-Hei 9-263294 discloses a marine propulsion unit including an engine and a power transmission mechanism transmitting driving force of the engine to a propeller in a predetermined and fixed reduction ratio. The marine propulsion unit is arranged in a manner such that the driving force of the engine is directly transmitted to the propeller via the power transmission mechanism and the rotational speed of the propeller increases proportionally with respect to the engine speed as the engine speed increases.

However, the marine propulsion unit (marine propulsion system) disclosed in JP-A-Hei 9-263294 has a problem in that it is difficult to improve acceleration performance in a low speed position in the case that speed reduction ratios of the power transmission mechanism are set to gain a larger maximum speed. Conversely, there is also a problem that it is difficult to gain a larger maximum speed in the case that the reduction ratios of the power transmission mechanism are set to improve the acceleration performance in the low speed position. In other words, the marine propulsion unit disclosed in JP-A-Hei 9-263294 has a problem in that it is difficult to satisfy both acceleration performance and maximum speed to a user's desired level.

SUMMARY OF THE INVENTION

In order to overcome the problems described above, preferred embodiments of the present invention provide a marine propulsion system that achieves desired levels of acceleration performance and maximum speed.

To achieve this, a preferred embodiment of the present invention provides a marine propulsion system including an engine; a propeller driven by the engine; a transmission mechanism arranged to transmit a driving force generated by the engine to the propeller with a speed shifted to at least a low speed reduction ratio and a high speed reduction ratio; a control lever section operated by a user in controlling drive of the engine; and a control portion arranged to control a shift between reduction ratios of the transmission mechanism based on operation of the control lever section by the user, and in which the control portion controls a shift between reduction ratios of the transmission mechanism based on a transmission control map which provides a reference for a shift between reduction ratios of the transmission mechanism taking into consideration an engine speed and a lever opening of the control lever section.

As described above, the marine propulsion system in accordance with the above preferred embodiment includes the transmission mechanism arranged to transmit the driving force generated by the engine to the propeller with the speed shifted to at least the low speed reduction ratio and the high speed reduction ratio. The transmission mechanism is arranged in a manner such that the driving force generated by the engine can be transmitted to the propeller with the speed shifted to the low speed reduction ratio. Accordingly, acceleration performance in the low speed position can be improved. Further, the transmission mechanism is arranged in a manner such that the driving force generated by the engine can be transmitted to the propeller with the speed shifted to the high speed reduction ratio. This allows a larger maximum speed to be obtained. As a result, both the acceleration performance and the maximum speed can approach levels that the user desires. The control portion controls a shift between reduction ratios of the transmission mechanism based on the transmission control map providing the reference for a shift between reduction ratios of the transmission mechanism taking into consideration the engine speed and the lever opening of the control lever section. Accordingly, the control portion controls the transmission mechanism to shift to the low speed reduction ratio to thereby increase the engine speed based on the transmission control map in the case that the engine speed is low compared to the magnitude of the lever opening of the control lever section operated by the user, for example. In other words, when the user suddenly positions the lever opening of the control lever section with the intention of initiating rapid acceleration, the reduction ratio of the transmission mechanism shifts to the low speed reduction ratio to improve the acceleration performance, thereby allowing a quick increase in the propeller speed. Accordingly, acceleration of a hull can be generated in response to the intent of the user. Further, when the reduction ratio of the transmission mechanism is set to the high speed reduction ratio, the control portion is arranged to slowly increase the propeller speed based on the transmission control map in the case that the user slowly positions the lever opening of the control lever section larger with the intent of providing a slow acceleration, for example. Accordingly, an increase in the engine speed can be prevented, thus minimizing fuel consumption by the engine. As a result, the transmission control map allows selection of an optimal reduction ratio in response to an intention of acceleration of the user and selection of a reduction ratio to prevent an increase in fuel consumption in response to a state of the hull.

Other features, elements, steps, characteristics and advantages of the present invention will become more apparent from the following detailed description of preferred embodiments of the present invention with reference to the attached drawings.

DETAILED DESCRIPTION OF THE PREFERRED EMBODIMENTS

Preferred embodiments of the present invention will be described hereinafter with reference to the drawings.

Figure 1:
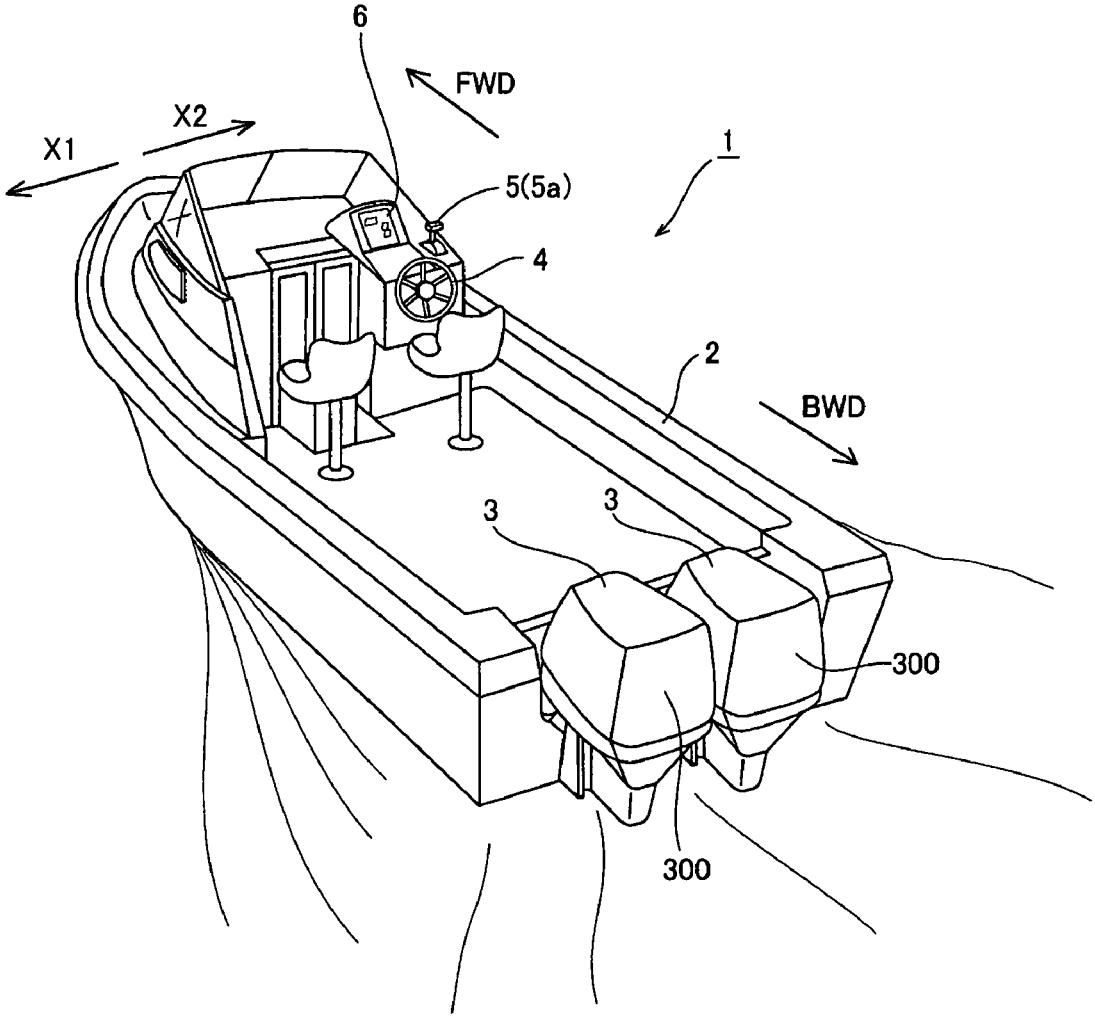
FIG. 1 is a perspective view showing a boat in which a marine propulsion system in accordance with a preferred embodiment of the present invention is installed.
Figure 2:
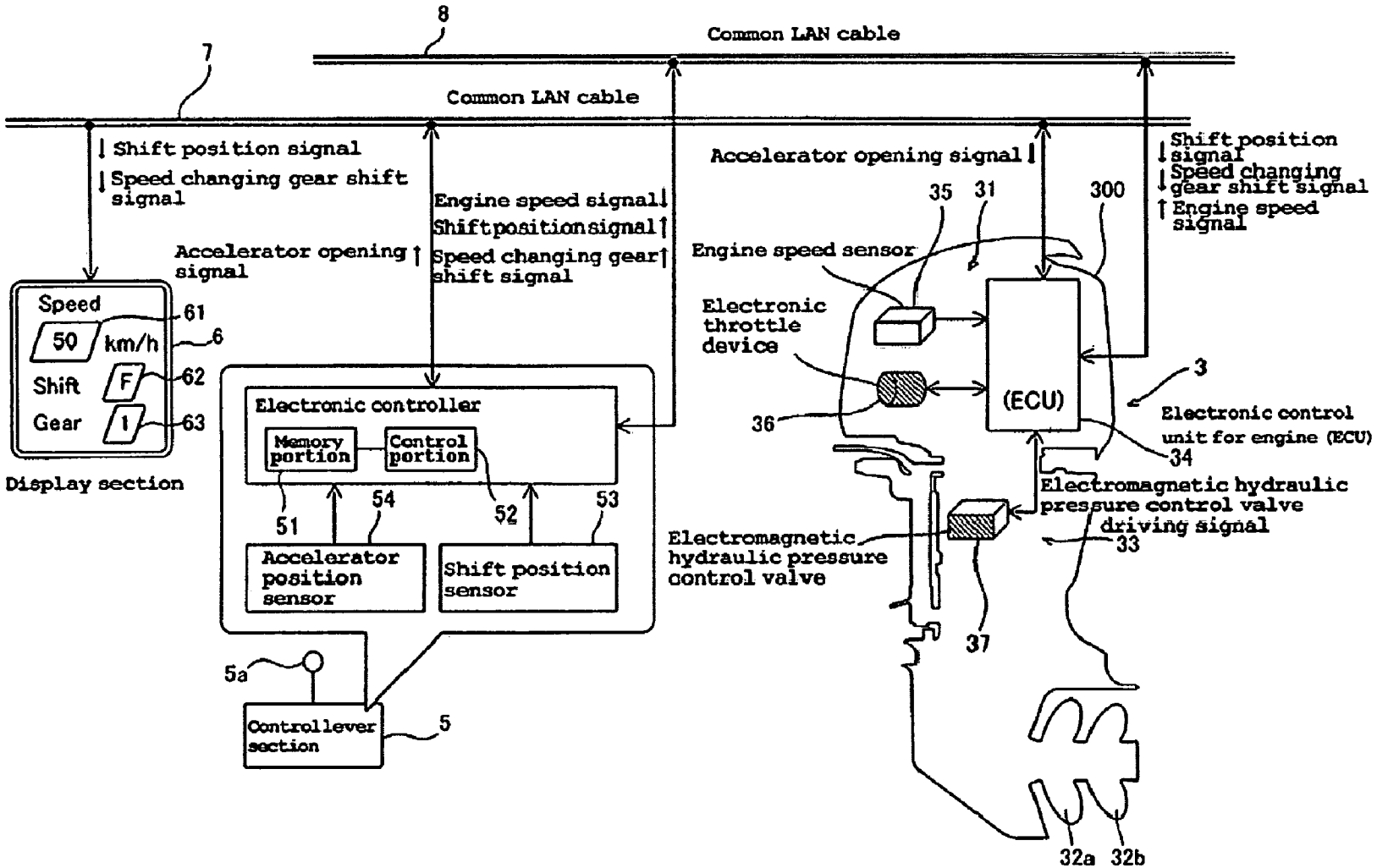
FIG. 2 is a block diagram showing a construction of a marine propulsion system in accordance with a preferred embodiment of the present invention.

FIG. 1 is a perspective view showing a boat in which a marine propulsion system in accordance with a preferred embodiment of the present invention is installed. FIG. 2 is a block diagram showing a construction of the marine propulsion system in accordance with a preferred embodiment of the present invention. FIGS. 3 through 7 are drawings specifically describing the construction of the marine propulsion system in accordance with the preferred embodiment shown in FIG. 1. In the figures, arrow FWD indicates the forward travel direction of the boat, and arrow BWD indicates the reverse travel direction of the boat. The constructions of a boat 1 in accordance with this preferred embodiment and the marine propulsion system installed in the boat 1 will be described with reference to FIGS. 1 through 7.

As shown in FIG. 1, the boat 1 in accordance with a preferred embodiment has a hull 2 floating on a water surface, two outboard motors 3 mounted on rear portions of the hull 2 and arranged to propel the hull 2, a steering section 4 arranged to steer the hull 2, a control lever section 5 disposed in a vicinity of the steering section 4 and including a lever 5*a* that turns in the fore-and-aft direction, and a display section 6 disposed in a vicinity of the control lever section 5. As shown in FIG. 2, the outboard motors 3, the control lever section 5, and the display section 6 are connected together by common LAN cables 7 and 8. The boat propulsion system includes the outboard motors 3, the steering section 4, the control lever section 5, the display section 6, the common LAN cables 7 and 8.

As shown in FIG. 1, the two outboard motors 3 are preferably symmetrically disposed with respect to the center in the width direction (directions of arrows X1 and X2) of the hull 2. The outboard motor 3 is covered by a casing 300. The casing 300 is preferably formed of resin and has a function to protect the inside of the outboard motor 3 from water and so forth. The outboard motor 3 includes an engine 31, two propellers 32*a* and 32*b* (see FIG. 4) converting a driving force of the engine 31 into a propulsion force of the boat 1, a transmission mechanism 33 capable of transmitting the driving force generated by the engine 31 to the propellers 32*a* and 32*b* with a speed thereof shifted to a low speed reduction ratio (approx. 1.33:1.00) and a high speed reduction ratio (approx. 1.0:1.0), and an ECU (electronic control unit for an engine) 34 arranged to electronically control the engine 31 and the transmission mechanism 33. The ECU 34 is an example of a "second control section" according to a preferred embodiment of the present invention. An engine speed sensor 35 arranged to detect the engine speed of the engine 31 and an electronic throttle device 36 arranged to control the throttle opening of a throttle valve (not shown) of the engine 31 based on an accelerator opening signal described below are connected to the ECU 34. The engine speed sensor 35 is disposed in a vicinity of a crankshaft 301 (see FIG. 4) of the engine 31. The engine speed sensor 35 is arranged to detect the rotational speed of the crankshaft 301 and to transmit the detected rotational speed of the crankshaft 301 to the ECU 34. The rotational speed of the crankshaft 301 is an example of an "engine speed" according to a preferred embodiment of the present invention. The electronic throttle device 36 controls the throttle opening of the throttle valve (not shown) of the engine 31 based on the accelerator opening signal from the ECU 34 and also has a function to transmit the throttle opening to the ECU 34.

In this preferred embodiment, the ECU 34 has a function to generate an electromagnetic hydraulic pressure control valve driving signal based on a speed changing gear shift signal and a shift position signal sent by a control portion 52 of the control lever section 5 described below. An electromagnetic hydraulic pressure control valve 37 is connected to the ECU 34. The ECU 34 controls the sending of the electromagnetic hydraulic pressure control valve driving signal to the electromagnetic hydraulic pressure control valve 37. The electromagnetic hydraulic pressure control valve 37 is driven based on the electromagnetic hydraulic pressure control valve driving signal, and thereby the transmission mechanism 33 is controlled. A construction and operation of the transmission mechanism 33 will be described below in detail.

In this preferred embodiment, the control lever section 5 includes a memory portion 51 in which a transmission control map described below is stored and the control portion 52 arranged to perform an operation, such as generating signals (for example, speed changing gear shift signal, shift position signal, and accelerator opening signal) to be sent to the ECU 34. The control portion 52 is an example of "first control section" according to a preferred embodiment of the present invention. The control lever section 5 further includes a shift position sensor 53 arranged to detect the shift position of the lever 5*a* and an accelerator position sensor 54 arranged to detect the opening or closing of the accelerator by operation on the lever 5*a*. The shift position sensor 53 is provided to detect which shift position the lever 5*a* is positioned among a neutral position, a position in front of the neutral position, and a position in the rear of the neutral position. The memory portion 51 and the control portion 52 are connected together. The control portion 52 is capable of reading out the transmission control map and so forth stored in the memory portion 51. The control portion 52 is connected to both the shift position sensor 53 and the accelerator position sensor 54. Thereby, the control portion 52 can obtain a detection signal (shift position signal) detected by the shift position sensor 53 and the accelerator opening signal detected by the accelerator position sensor 54.

The control portion 52 is connected to each of the common LAN cables 7 and 8. Each of the common LAN cables 7 and 8 is connected to the ECU 34. The common LAN cables have functions to transmit a signal generated by the control portion 52 to the ECU 34 and to transmit a signal generated by the ECU 34 to the control portion 52. Each of the common LAN cables 7 and 8 is capable of communication between the control portion 52 and the ECU 34. The common LAN cable 8 is electrically independent of the common LAN cable 7. The common LAN cable 7 is an example of a "first communication line" according to a preferred embodiment of the present invention. The common LAN cable 8 is an example of a "second communication line" according to a preferred embodiment of the present invention.

Specifically, the control portion 52 transmits the shift position signal of the lever 5*a* detected by the shift position sensor 53 to the display section 6 and the ECU 34 via the common LAN cable 7. The control portion 52 transmits the shift position signal not via the common LAN cable 8 but only via the common LAN cable 7. The control portion 52 transmits the accelerator opening signal detected by the accelerator position sensor 54 to the ECU 34 not via the common LAN cable 7 but only via the common LAN cable 8. The control portion 52 is capable of receiving an engine speed signal sent from the ECU 34 via the common LAN cable 8.

In this preferred embodiment, the control portion 52 has a function to electrically control a shift between the reduction ratios of the transmission mechanism 33 based on the operation of the control lever section 5 by a user. Specifically, the control portion 52 has a function to generate the speed changing gear shift signal arranged to control the transmission mechanism 33 so that it shifts to either of the low speed reduction ratio and the high speed reduction ratio based on the transmission control map provided by accelerator opening and engine speed stored in the memory portion 51. The transmission control map will be described below in detail. The control portion 52 sends the generated speed changing gear shift signal to the ECU 34 via the common LAN cables 7 and 8. The control portion 52 outputs the speed changing gear shift signal in either of the cases that an operating state of at least either one of the two outboard motors 3 satisfies a condition for a shift and that an operation state of the predetermined outboard motor 3 between the two outboard motors 3 satisfies the condition for a shift.

Figure 3:
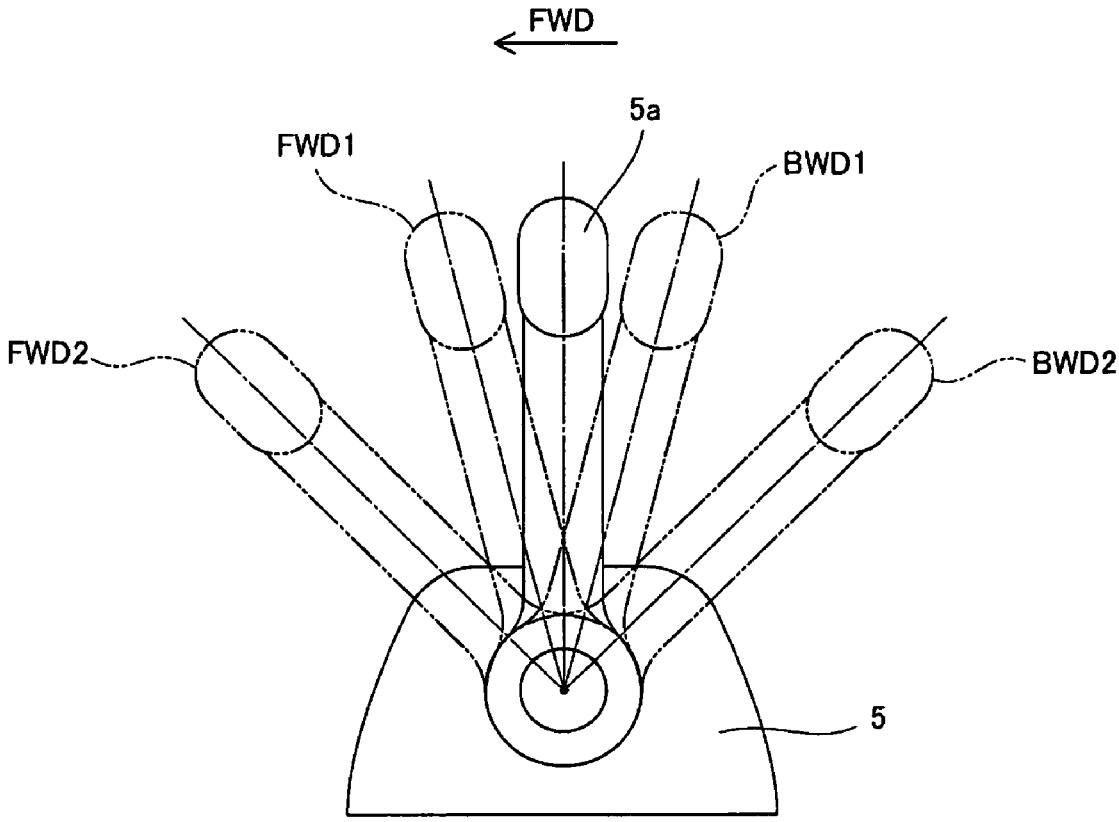
FIG. 3 is a side view illustrating a construction of a control lever section of the marine propulsion system shown in FIG. 1.

The transmission mechanism 33 is controlled so that the hull 2 can travel forward in the case that the lever 5*a* of the control lever section 5 is turned forward (direction of arrow FWD) (see FIG. 3). The transmission mechanism 33 is controlled so that it retains the neutral state in which the hull 2 is propelled neither forward nor rearward in the case that the lever 5*a* is not turned in the fore-and-aft direction as the lever 5*a* of the control lever section 5 (see solid lines in FIG. 3). The transmission mechanism 33 is controlled so that the hull 2 can travel rearward in the case that the lever 5*a* of the control lever section 5 is turned rearward (direction opposite to arrow FWD) (see FIG. 3).

The transmission mechanism 33 performs a shift-in operation (release from the neutral state) with the throttle valve (not shown) of the engine 31 fully closed (idling state) when the lever 5*a* of the control lever 5 is turned to position FWD1 in FIG. 3. The throttle valve (not shown) of the engine 31 fully opens when the lever 5*a* of the control lever 5 is turned to position FWD2 in FIG. 3.

Similarly to the case in which the lever 5*a* of the control lever section 5 is turned in the direction of arrow FWD, in the case that the lever 5*a* is turned to position BWD1 in FIG. 3 in the direction opposite to the direction of arrow FWD, the transmission mechanism 33 performs a shift-in operation (release from the neutral state) with the throttle valve (not shown) of the engine 31 fully closed (idling state). The throttle valve (not shown) of the engine 31 fully opens when the lever 5*a* of the control lever 5 is turned to position BWD2 in FIG. 3.

The display section 6 includes a speed display 61 indicating the traveling speed of the boat 1, a shift position display 62 indicating the shift position of the lever 5*a* of the control lever section 5, and a gear display 63 indicating a gear in the engaged state in the transmission mechanism 33. The traveling speed of the boat 1 displayed on the speed display 61 is calculated by the ECU 34 based on the engine speed sensor 35 and the intake state of the engine 31. Calculated data about the traveling speed of the boat 1 are transmitted to the display section 6 via the common LAN cables 7 and 8. The shift position displayed on the shift position display 62 is displayed based on the shift position signal sent from the control portion 52 of the control lever section 5. The gear in the engaged state in the transmission mechanism 33 displayed on the gear display 63 is displayed based on the speed changing gear shift signal sent from the control portion 52 of the control lever section 5. In other words, the display section 6 has a function to inform the user (operator of the boat) about the traveling state of the boat 1.

Figure 4:
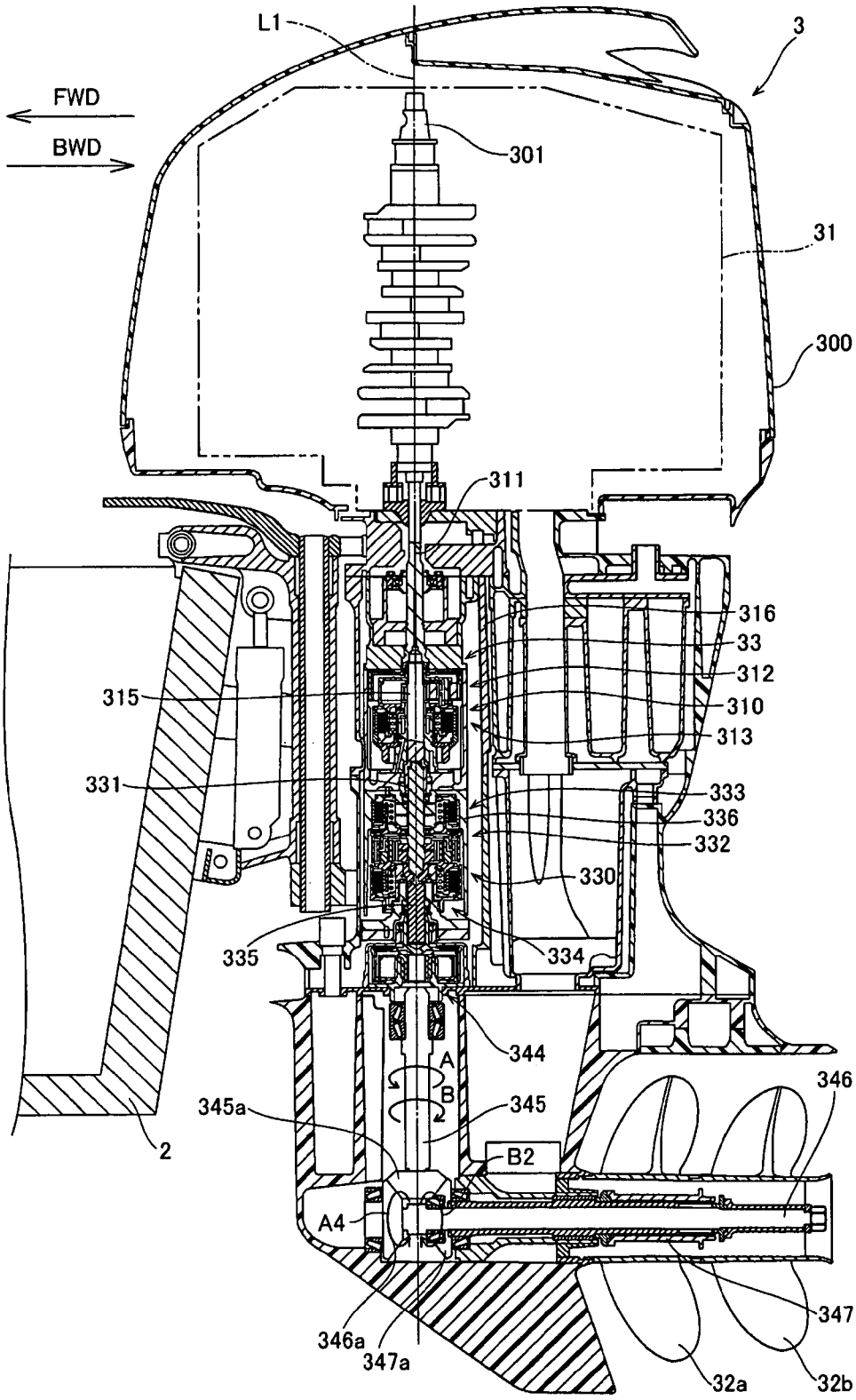
FIG. 4 is a cross-sectional view illustrating a construction of a marine propulsion system main body of the marine propulsion system shown in FIG. 1.

Next, a construction of the engine 31 and the transmission mechanism 33 will be described. As shown in FIG. 4, the engine 31 has the crankshaft 301 rotating around axial line L1. The engine 31 generates a driving force by rotation of the crankshaft 301. An upper portion of an upper transmission shaft 311 of the transmission mechanism 33 is connected to the crankshaft 301. The upper transmission shaft 311 is disposed along axial line L1 and rotates around axial line L1 together with rotation of the crankshaft 301.

The transmission mechanism 33 includes the upper transmission shaft 311 described above to which the driving force of the engine 31 is input, and includes an upper transmission section 310 making a shift so that the boat 1 can make either high speed travel or low speed travel and a lower transmission section 330 making a shift so that the boat 1 can make either forward travel or reverse travel. In other words, the transmission mechanism 33 is arranged to transmit the driving force generated by the engine 31 to the propellers 32*a* and 32*b* with the speed shifted to the low speed reduction ratio (for example, 1.33:1) and the high speed reduction ratio (for example, 1:1) in the forward travel and also capable of transmitting the driving force to the propellers 32*a* and 32*b* with the speed shifted to the low speed reduction ratio and the high speed reduction ratio in the reverse travel.

Figure 5:
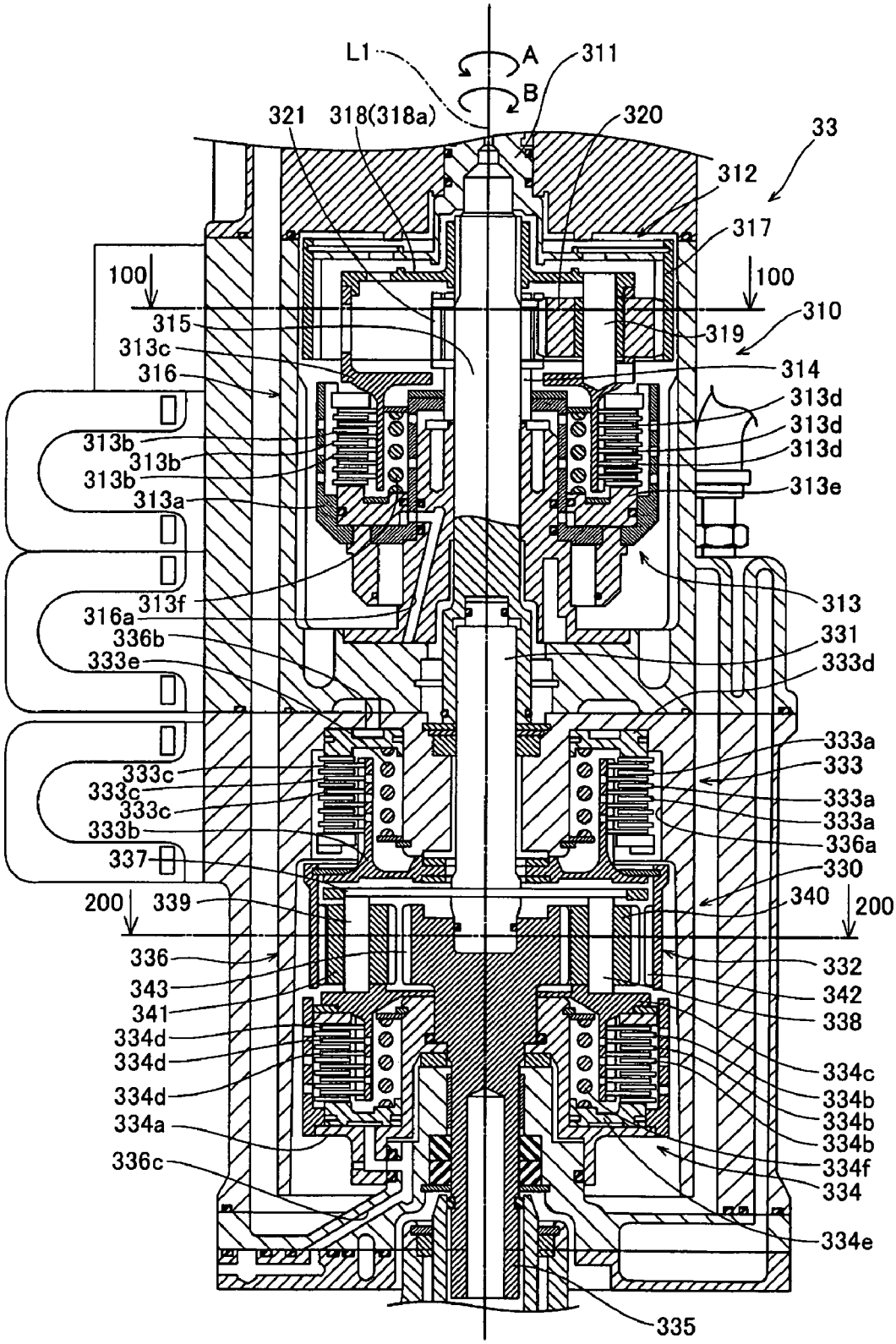
FIG. 5 is a cross-sectional view illustrating a construction of a transmission mechanism of the marine propulsion system main body of the marine propulsion system shown in FIG. 1.

As shown in FIG. 5, the upper transmission section 310 includes the upper transmission shaft 311 described above, a planetary gear section 312 capable of reducing the rotational speed of the driving force of the upper transmission shaft 311, a clutch 313 and a one-way clutch 314 arranged to control a rotation of the planetary gear section 312, an intermediate shaft 315 to which the driving force of the upper transmission shaft 311 is transmitted via the planetary gear section 312, and an upper case section 316 arranged to define a contour of the upper transmission section 310 with a plurality of members. The upper transmission section 310 is arranged in a manner such that the intermediate shaft 315 rotates at a rotational speed that is substantially not reduced compared to the rotational speed of the upper transmission shaft 311 in the case that the clutch 313 is in the engaged state. On the other hand, the upper transmission section 310 is preferably arranged in a manner such that the rotational speed of the upper transmission shaft 311 is reduced by rotation of the planetary gear section 312 and the intermediate shaft 315 rotates at the reduced speed in the case that the clutch 313 is in the disengaged state.

Figure 6:
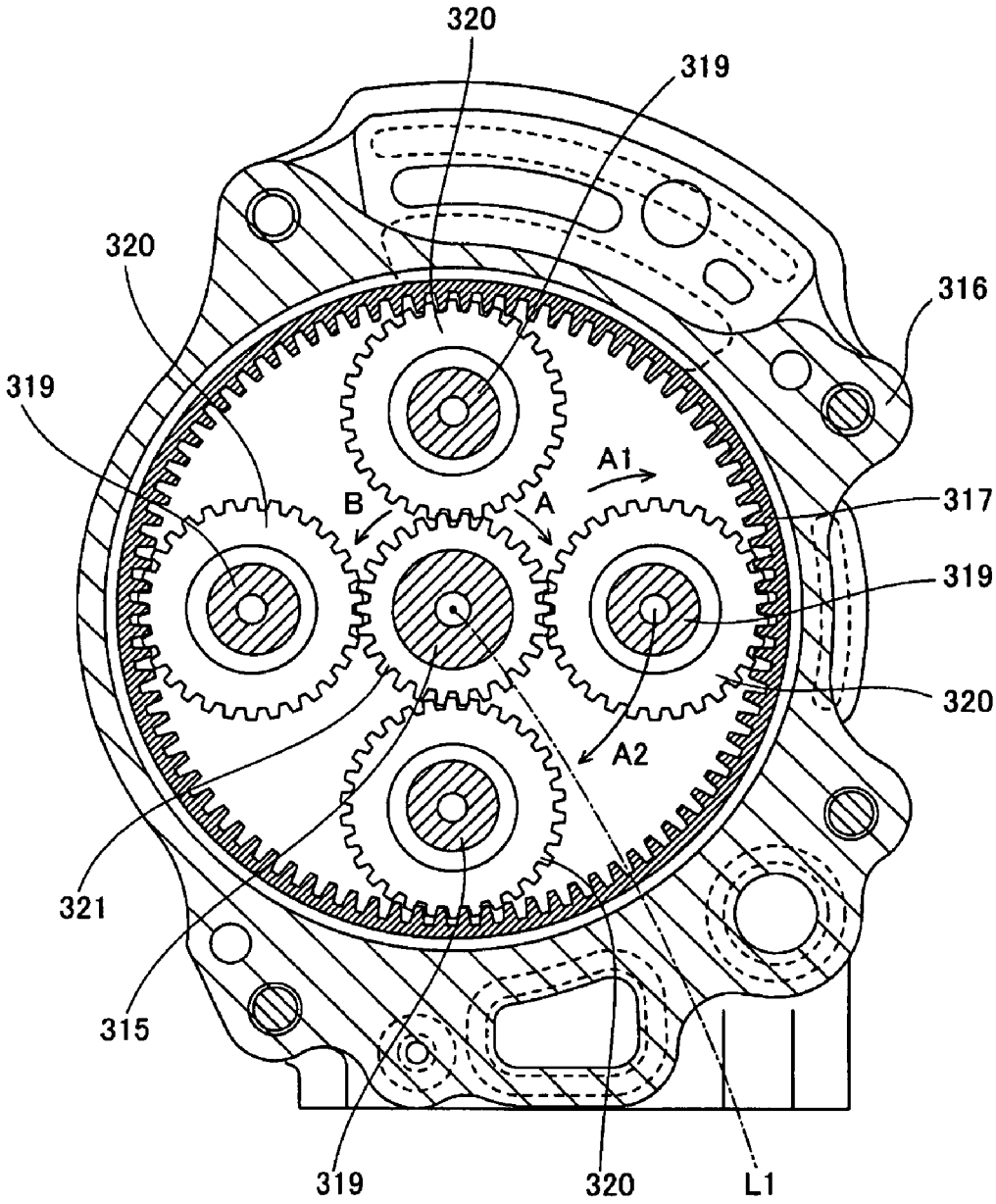
FIG. 6 is a cross-sectional view taken along line 100-100 of FIG. 5.

Specifically, a ring gear 317 is provided on a lower portion of the upper transmission shaft 311. A flange member 318 is fitted to an upper portion of the intermediate shaft 315 by spline-fitting, for example. The flange member 318 is disposed in the ring gear 317 (on a side facing axial line L1). As shown in FIGS. 5 and 6, four shaft members 319 are fixed to a flange 318*a* of the flange member 318. Four planetary gears 320 are rotatably mounted on the respective four shaft members 319. Each of the planetary gears 320 is meshed with the ring gear 317. Each of the four planetary gears 320 is meshed with a sun gear 321 capable of rotating around axial line L1. As shown in FIG. 5, the sun gear 321 is supported by the one-way clutch 314. The one-way clutch 314 is mounted on the upper case section 316 and can rotate only in direction A. Thereby, the sun gear 321 is arranged to rotate in only one direction (direction A).

The clutch 313 is preferably defined by a wet type multi-plate clutch. The clutch 313 preferably includes an outer case section 313*a* supported rotatably in only direction A by the one-way clutch 314, a plurality of clutch plates 313*b* disposed in an inner periphery of the outer case section 313*a* at predetermined intervals from each other, an inner case section 313*c* at least partially disposed inside the outer case 313*a*, and a plurality of clutch plates 313*d* mounted on the inner case section 313*c* and disposed in spaces between the plurality of clutch plates 313*b*. The clutch 313 enters the engaged state in which the outer case section 313*a* and the inner case section 313*c* unitarily rotate in the case that the clutch plates 313*b* of the outer case section 313*a* and the clutch plates 313*d* of the inner case section 313*c* contact with each other. Meanwhile, the clutch 313 enters the disengaged state in which the outer case section 313*a* and the inner case section 313*c* do not unitarily rotate in the case that the clutch plates 313*b* of the outer case section 313*a* and the clutch plates 313*d* of the inner case section 313*c* are separated from each other.

Specifically, a piston 313*e* slidable on an inner peripheral surface of the outer case section 313*a* is disposed in the outer case section 313*a*. The piston 313*e* moves the plurality of the clutch plates 313*b* of the outer case section 313*a* in a direction in which the piston 313*e* slides when it slides on the inner peripheral surface of the outer case section 313*a*. A compression coil spring 313*f* is disposed in the outer case section 313*a*. The compression coil spring 313*f* is disposed to urge the piston 313*e* in a direction in which the clutch plates 313*b* of the outer case section 313*a* are separated from the clutch plates 313*d* of the inner case section 313*c*. The piston 313*e* slides on the inner peripheral surface of the outer case section 313*a* against reaction of the compression coil spring 313*f* when the electromagnetic hydraulic pressure control valve 37 described above increases the pressure of the oil flowing through an oil passage 316*a* of the upper case section 316. Accordingly, the pressure of the oil flowing through the oil passage 316*a* of the upper case section 316 is increased or reduced, thereby allowing contact and separation between the clutch plates 313*b* of the outer case section 313*a* and the clutch plates 313*d* of the inner case section 313*c*. Therefore, the clutch 313 can be engaged or disengaged.

Lower ends of the four shaft members 319 are mounted on an upper portion of the inner case section 313*c*. In other words, the inner case section 313*c* is connected to the flange member 318 on which each of upper portions of the four shaft members 319 are mounted via the four shaft members 319. Thereby, the inner case section 313*c*, the flange member 318, and the shaft members 319 can simultaneously rotate around axial line L1.

The planetary gear section 312 and the clutch 313 are arranged as described above. Therefore, in the case that the clutch 313 is disengaged, the ring gear 317 rotates in direction A together with the upper transmission shaft 311 rotating in direction A. In this case, the sun gear 321 does not rotate in direction B opposite to direction A. Therefore, as shown in FIG. 6, each of the planetary gears 320 rotates around the shaft member 319 in direction A1 and at the same time revolves around axial line L1 in direction A2 together with the shaft member 319. Thereby, the flange member 318 (see FIG. 5) rotates around axial line L1 in direction A while the shaft members 319 revolve in direction A2. As a result, the intermediate shaft 315 fitted to the flange member 318 by spline-fitting can be rotated around axial line L1 in direction A at the reduced rotational speed compared to the rotational speed of the upper transmission shaft 311.

The planetary gear section 312 and the clutch 313 are arranged as described above. Accordingly, in the case that the clutch 313 is engaged, the ring gear 317 rotates in direction A together with the upper transmission shaft 311 rotating in direction A. In this case, the sun gear 321 does not rotate in direction B opposite to direction A. Therefore, each of the planetary gears 320 rotates around the shaft member 319 in direction A1 and at the same time revolves around axial line L1 in direction A2 together with the shaft member 319. At this point, since the clutch 313 is engaged, the outer case section 313*a* (see FIG. 5) of the clutch 313 rotates in direction A together with the one-way clutch 314 (see FIG. 5). Thereby, the sun gear 321 rotates around axial line L1 in direction A. Therefore, the planetary gears 320 do not substantially rotate around the shaft members 319, but the shaft members 319 revolve around axial line L1 to move in direction A. Accordingly, the flange member 318 rotates at a speed generally equivalent to the rotational speed of the upper transmission shaft 311 since the speed is not substantially reduced by the planetary gears 320. As a result, the intermediate shaft 315 can be rotated around axial line L1 in direction A at the speed generally equivalent to the rotational speed of the upper transmission shaft 311.

As shown in FIG. 5, the lower transmission section 330 is provided below the upper transmission section 310. The lower transmission section 330 includes an intermediate transmission shaft 331 connected to the intermediate shaft 315, a planetary gear section 332 capable of reducing the rotational speed of the driving force of the intermediate transmission shaft 331, forward-reverse switching clutches 333 and 334 controlling rotation of the planetary gear section 332, a lower transmission shaft 335 to which the driving force of the intermediate transmission shaft 331 is transmitted via the planetary gear section 332, and a lower case section 336 defining a contour of the lower transmission section 330. Further, the lower transmission section 330 is arranged in a manner such that the lower transmission shaft 335 rotates in a direction (direction B) opposite to the rotational direction (direction A) of the intermediate shaft 315 (the upper transmission shaft 311) in the case that the forward-reverse switching clutch 333 is engaged and the forward-reverse switching clutch 334 is disengaged. In this case, the lower transmission section 330 does not rotate propeller 32*b* but rotates only the propeller 32*a* so that the boat 1 can travel rearward. On the other hand, the lower transmission section 330 is arranged in a manner such that the lower transmission shaft 335 rotates in the same direction as the rotational direction (direction A) of the intermediate shaft 315 (the upper transmission shaft 311) in the case that the forward-reverse switching clutch 333 is disengaged and the forward-reverse switching clutch 334 is engaged. In this case, the lower transmission section 330 rotates the propeller 32*a* in a direction opposite to the case of the reverse travel of the boat 1 and rotates the propeller 32*b* in a direction opposite to the rotational direction of the propeller 32*a* so that the boat 1 can travel forward. The lower transmission 330 is arranged so that neither of the forward-reverse switching clutches 333 and 334 enter the engaged state. The lower transmission section 330 is arranged so that rotation of the intermediate shaft 315 (the upper transmission shaft 311) is not transmitted to the lower transmission shaft 335 (the lower transmission section 330 becomes the neutral state) in the case that both the forward-reverse switching clutches 333 and 334 are in the disengaged state.

Figure 7:
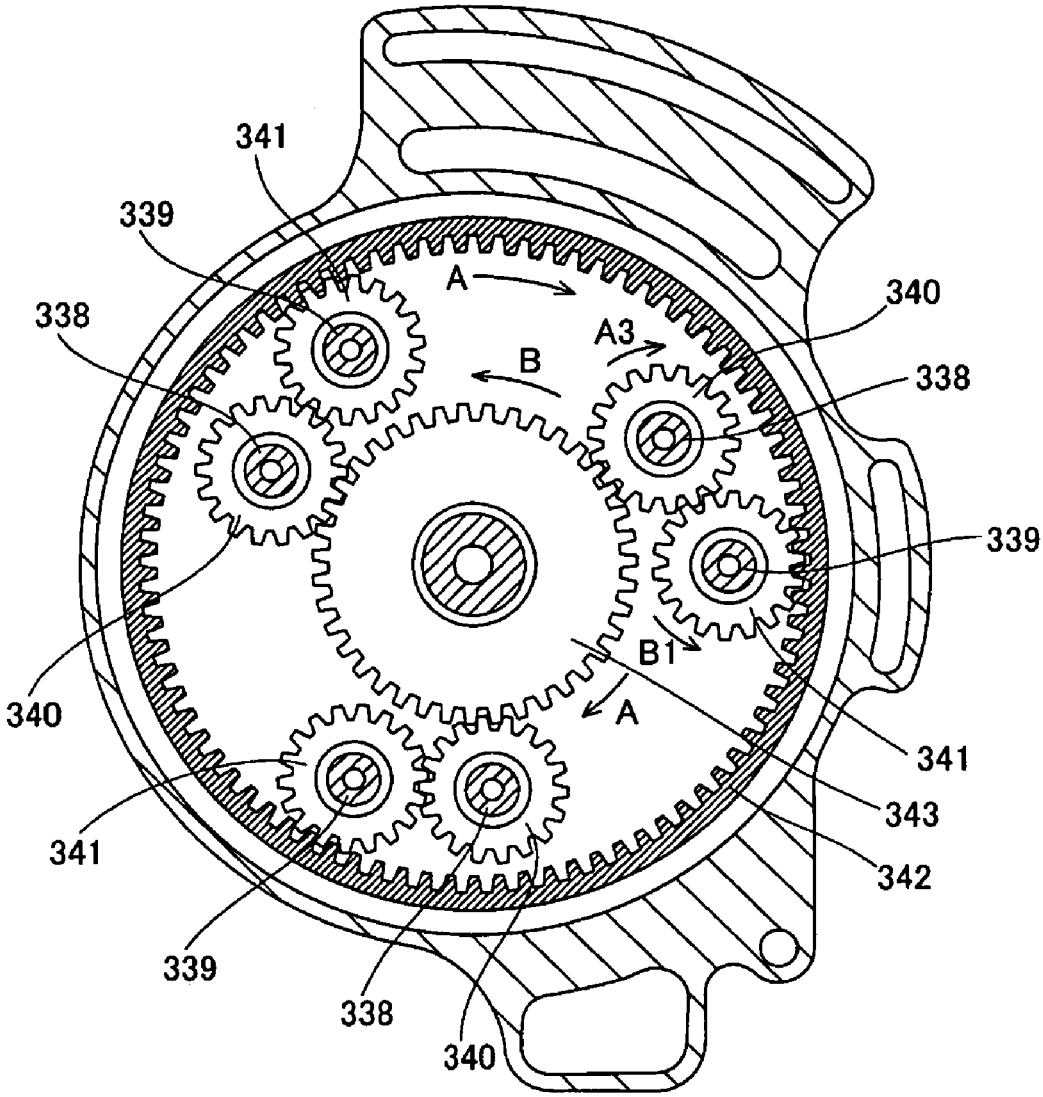
FIG. 7 is a cross-sectional view taken along line 200-200 of FIG. 5.

Specifically, the intermediate transmission shaft 331 rotates together with the intermediate shaft 315. A flange 337 is provided on a lower portion of the intermediate transmission shaft 331. As shown in FIGS. 5 and 7, three inner shaft members 338 and three outer shaft members 339 are fixed to the flange 337. Three planetary gears 340 are rotatably mounted on the respective three inner shaft members 338. Each of the inner planetary gears 340 is meshed with the sun gear 343 described below. Three planetary gears 341 are rotatably mounted on the respective three outer shaft members 339. Each of the three outer planetary gears 341 are meshed with the inner planetary gear 340 and with a ring gear 342 described below.

The forward-reverse switching clutch 333 is provided in an upper portion in the lower case section 336. The forward-reverse switching clutch 333 is preferably arranged with a wet type multi-plate clutch. A portion thereof is arranged with a recess 336*a* of the lower case section 336. The forward-reverse switching clutch 333 is arranged mainly with a plurality of clutch plates 333*a* disposed in an inner periphery of the recess 336*a* at predetermined intervals from each other, an inner case section 333*b* at least partially disposed inside the recess 336*a*, and a plurality of clutch plates 333*c* mounted on the inner case section 333*b* and disposed in spaces between the plurality of clutch plates 333*a*. The forward-reverse switching clutch 333 is arranged in a manner such that the lower case section 336 restrains rotation of the inner case section 333*b* in the case that the clutch plates 333*a* of the recess 336*a* and the clutch plates 333*c* of the inner case section 333*b* contact with each other. Meanwhile, the forward-reverse switching clutch 333 is arranged in a manner such that the inner case section 333*b* freely rotates with respect to the lower case section 336 in the case that the clutch plates 333*a* of the recess 336*a* and the clutch plates 333*c* of the inner case section 333*b* are separated from each other.

Specifically, a piston 333*d* slidable on an inner peripheral surface of the recess 336*a* is disposed in the recess 336*a* of the lower case section 336. The piston 333*d* moves the clutch plates 333*a* of the recess 336*a* in a direction in which the piston 333*d* slides when it slides on the inner peripheral surface of the recess 336*a*. A compression coil spring 333*e* is disposed in the recess 336*a* of the lower case section 336. The compression coil spring 333*e* is disposed to urge the piston 333*d* in a direction in which the clutch plates 333*a* of the recess 336*a* are separated from the clutch plates 333*c* of the inner case section 333*b*. The piston 333*d* slides on the inner peripheral surface of the recess 336*a* against reaction of the compression coil spring 333*e* when the electromagnetic hydraulic pressure control valve 37 described above increases the pressure of the oil flowing through an oil passage 336*b* of the lower case section 336. Accordingly, the pressure of the oil flowing through the oil passage 336*b* of the lower case section 336 is increased or reduced, thereby allowing engagement and disengagement of the forward-reverse switching clutch 333.

A ring-shaped ring gear 342 is mounted in the inner case section 333*b* of the forward-reverse switching clutch 333. As shown in FIGS. 5 and 7, the ring gear 342 is meshed with the three outer planetary gears 341.

As shown in FIG. 5, the forward-reverse switching clutch 334 is provided in a lower portion of the lower case section 336 and preferably arranged with a wet type multi-plate clutch. The forward-reverse switching clutch 334 preferably includes an outer case section 334*a*, a plurality of clutch plates 334*b* disposed in an inner periphery of the outer case section 334*a* at predetermined intervals from each other, an inner case section 334*c* at least partially disposed inside the outer case 334*a*, and a plurality of clutch plates 334*d* mounted on the inner case section 334*c* and disposed in spaces between the plurality of clutch plates 334*b*. The forward-reverse switching clutch 334 is arranged in a manner such that the inner case section 334*c* and the outer case section 334*a* unitarily rotate around axial line L1 in the case that the clutch plates 334*b* of the outer case section 334*a* and the clutch plates 334*d* of the inner case section 334*c* contact with each other. On the other hand, the forward-reverse switching clutch 334 is arranged in a manner such that the inner case section 334*c* freely rotates with respect to the outer case section 334*a* in the case that the clutch plates 334*b* of the outer case section 334*a* and the clutch plates 334*d* of the inner case section 334*c* are separated from each other.

Specifically, a piston 334*e* slidable on an inner peripheral surface of the outer case section 334*a* is disposed in the outer case section 334*a*. The piston 334*e* moves the plurality of the clutch plates 334*b* of the outer case section 334*a* in a direction in which the piston 334*e* slides when it slides on the inner peripheral surface of the outer case section 334*a*. A compression coil spring 334*f* is disposed in the outer case section 334*a*. The compression coil spring 334*f* is disposed to urge the piston 334*e* in a direction in which the clutch plates 334*b* of the outer case section 334*a* are separated from the clutch plates 334*d* of the inner case section 334*c*. The piston 334*e* slides on the inner peripheral surface of the outer case section 334*a* against reaction of the compression coil spring 334*f* when the electromagnetic hydraulic pressure control valve 37 described above increases the pressure of the oil flowing through an oil passage 336*c* of the lower case section 336. Accordingly, the pressure of the oil flowing through the oil passage 336*c* of the lower case section 336 is increased or reduced, thereby allowing engagement and disengagement of the forward-reverse switching clutch 334.

The three inner shaft members 338 and the three outer shaft members 339 are fixed to the inner case section 334*c* of the forward-reverse switching clutch 334. In other words, the inner case section 334*c* is connected to the flange 337 by the three inner shaft members 338 and the three outer shaft members 339 and rotates around axial line L1 together with the flange 337. The outer case section 334*a* of the forward-reverse switching clutch 334 is mounted on the lower transmission shaft 335 and rotates around axial line L1 together with the lower transmission shaft 335.

The sun gear 343 is unitarily arranged with an upper portion of the lower transmission shaft 335. As shown in FIG. 7, the sun gear 343 is meshed with the inner planetary gears 340 as described above. The inner planetary gears 340 are meshed with the outer planetary gears 341 meshed with the ring gear 342. The sun gear 343 rotates around axial line L1 in direction B via the inner planetary gears 340 and the outer planetary gears 341 when the flange 337 rotates in direction A together with the intermediate transmission shaft 331 rotating around axial line L1 in direction A in the case that the ring gear 342 does not rotate due to engagement of the forward-reverse switching clutch 333.

The planetary gear section 332, the forward-reverse switching clutches 333 and 334 are arranged as described above. Thereby, in the case that the forward-reverse switching clutch 333 is engaged, the ring gear 342 mounted on the inner case section 333*b* is fixed to the lower case section 336. At this point, the forward-reverse switching clutch 334 is disengaged as described above. Therefore, the outer case section 334*a* and the inner case section 334*c* of the forward-reverse switching clutch 334 can rotate separately. In this case, when the flange 337 rotates around axial line L1 in direction A together with the intermediate transmission shaft 331 rotating around axial line L1 in direction A, each of the three inner shaft members 338 and the three outer shaft members 339 revolves around axial line L1 in direction A. Now, the outer planetary gears 341 mounted on the outer shaft members 339 rotate around the outer shaft members 339 in direction B. The inner planetary gears 340 rotate around the inner shaft members 338 in direction A3 while the outer planetary gears 341 rotate around the outer shaft members 339 in direction B1. Accordingly, the sun gear 343 rotates around axial line L1 in direction B. As a result, as shown in FIG. 5, the lower transmission shaft 335 rotates around axial line L1 together with the outer case section 334*a* although the inner case section 334*c* rotates around axial line L1 in direction A. Accordingly, the lower transmission shaft 335 rotates in the direction (direction B) opposite to the rotational direction (direction A) of the intermediate shaft 315 (the upper transmission shaft 311) in the case that the forward-reverse switching clutch 333 is in the engaged state and the forward-reverse switching clutch 334 is in the disengaged state.

The planetary gear section 332, the forward-reverse switching clutches 333 and 334 are arranged as described above. Thereby, in the case that the forward-reverse switching clutch 333 is disengaged, the ring gear 342 mounted on the inner case section 333*b* can freely rotate with respect to the lower case section 336. In this case, the forward-reverse switching clutch 334 can enter either the engaged state or the disengaged state. Descriptions will be made about a case that the forward-reverse switching clutch 334 is engaged.

In the case that the flange 337 rotates around axial line L1 in direction A together with the intermediate transmission shaft 331 rotating around axial line L1 in direction A, the three inner shaft members 338 and the three outer shaft members 339 revolve around axial line L1 in direction A as shown in FIG. 7. In this case, the ring gear 342 meshed with the outer planetary gears 341 freely rotate. Therefore, the inner planetary gears 340 and the outer planetary gears 341 remain idle. In other words, the driving force of the intermediate transmission shaft 331 is not transmitted to the sun gear 343. Meanwhile, since the forward-reverse switching clutch 334 is engaged, as shown in FIG. 5, the outer case section 334*a* rotates around axial line L1 in direction A, when the inner case section 334*c*, which can rotate around axial line L1 in direction A together with the three inner shaft members 338 and the three outer shaft members 339, rotates around axial line L1 in direction A of the inner case section. Accordingly, the lower transmission shaft 335 rotates around axial line L1 in direction A together with the outer case section 334*a*. As a result, the lower transmission shaft 335 can be rotated in the same direction as the rotational direction (direction A) of the intermediate shaft 315 (the upper transmission shaft 311) in the case that the forward-reverse switching clutch 333 is in the disengaged state and the forward-reverse switching clutch 334 is in the engaged state.

As shown in FIG. 4, a speed reducing device 344 is provided below the transmission mechanism 33. The lower transmission shaft 335 of the transmission mechanism 33 is input to the speed reducing device 344. The speed reducing device 344 has a function to reduce the rotational speed of the driving force input by the lower transmission shaft 335. A drive shaft 345 is provided below the speed reducing device 344. The drive shaft 345 rotates in the same direction as the lower transmission shaft 335. A bevel gear 345*a* is provided in a lower portion of the drive shaft 345.

A bevel gear 346*a* of an inner output shaft 346 and a bevel gear 347*a* of an outer output shaft 347 are meshed with the bevel gear 345*a* of the drive shaft 345. The inner output shaft 346 is disposed to extend rearward (direction of arrow BWD). The propeller 32*b* described above is mounted on a portion of the inner output shaft 346 in the direction of arrow BWD. The outer output shaft 347 is disposed to extend in the direction of arrow BWD similarly to the inner output shaft 346. The propeller 32*a* described above is mounted on a portion of the outer output shaft 347 in the direction of arrow BWD. The outer output shaft 347 preferably is hollow. The inner output shaft 346 is inserted in a cavity of the outer output shaft 347. The inner output shaft 346 and the outer output shaft 347 can rotate independently of each other.

The bevel gear 346*a* is meshed with a side of the bevel gear 345*a* in the direction of arrow FWD. The bevel gear 347*a* is meshed with a side of the bevel gear 345*a* in the direction of arrow BWD. Thereby, when the bevel gear 346*a* rotates, the inner output shaft 346 and the outer output shaft 347 rotate in the directions different from each other.

Specifically, in the case that the drive shaft 345 rotates in direction A, the bevel gear 346*a* rotates in direction A4. The propeller 32*b* rotates in direction A4 via the inner output shaft 346 together with rotation of the bevel gear 346*a* in direction A4. Further, in the case that the drive shaft 345 rotates in direction A, the bevel gear 347*a* rotates in direction B2. The propeller 32*a* rotates in direction B2 via the outer output shaft 347 together with rotation of the bevel gear 347*a* in direction B2. The propeller 32*a* rotates in direction B2 and the propeller 32*b* rotates in direction A4 (direction opposite to direction B2). Thereby, the boat 1 travels in the direction of arrow FWD (forward).

Further, in the case that the drive shaft 345 rotates in direction B, the bevel gear 346*a* rotates in direction B2. The propeller 32*b* rotates in direction B2 via the inner output shaft 346 together with rotation of the bevel gear 346*a* in direction B2. The bevel gear 347*a* rotates in direction A4 in the case that the drive shaft 345 rotates in direction B. In this case, the outer output shaft 347 does not rotate in direction A4. The propeller 32*a* rotates in neither direction A4 nor direction B2. In other words, only the propeller 32*b* rotates in direction A4. The propeller 32*b* rotates in direction B2, and thereby the boat 1 travels in the direction of arrow BWD (rearward).

Figure 8:
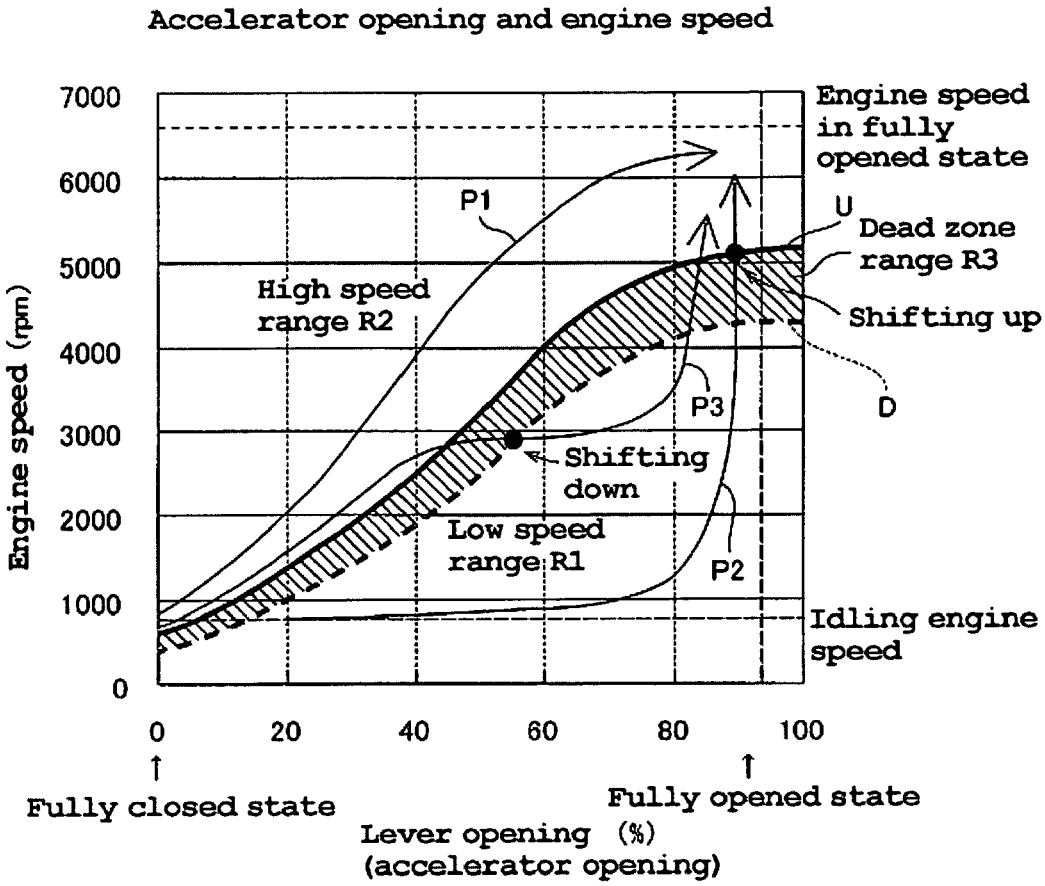
FIG. 8 is a diagram showing a transmission control map stored in a memory portion of a marine propulsion system in accordance with a preferred embodiment of the present invention.
Figure 9:
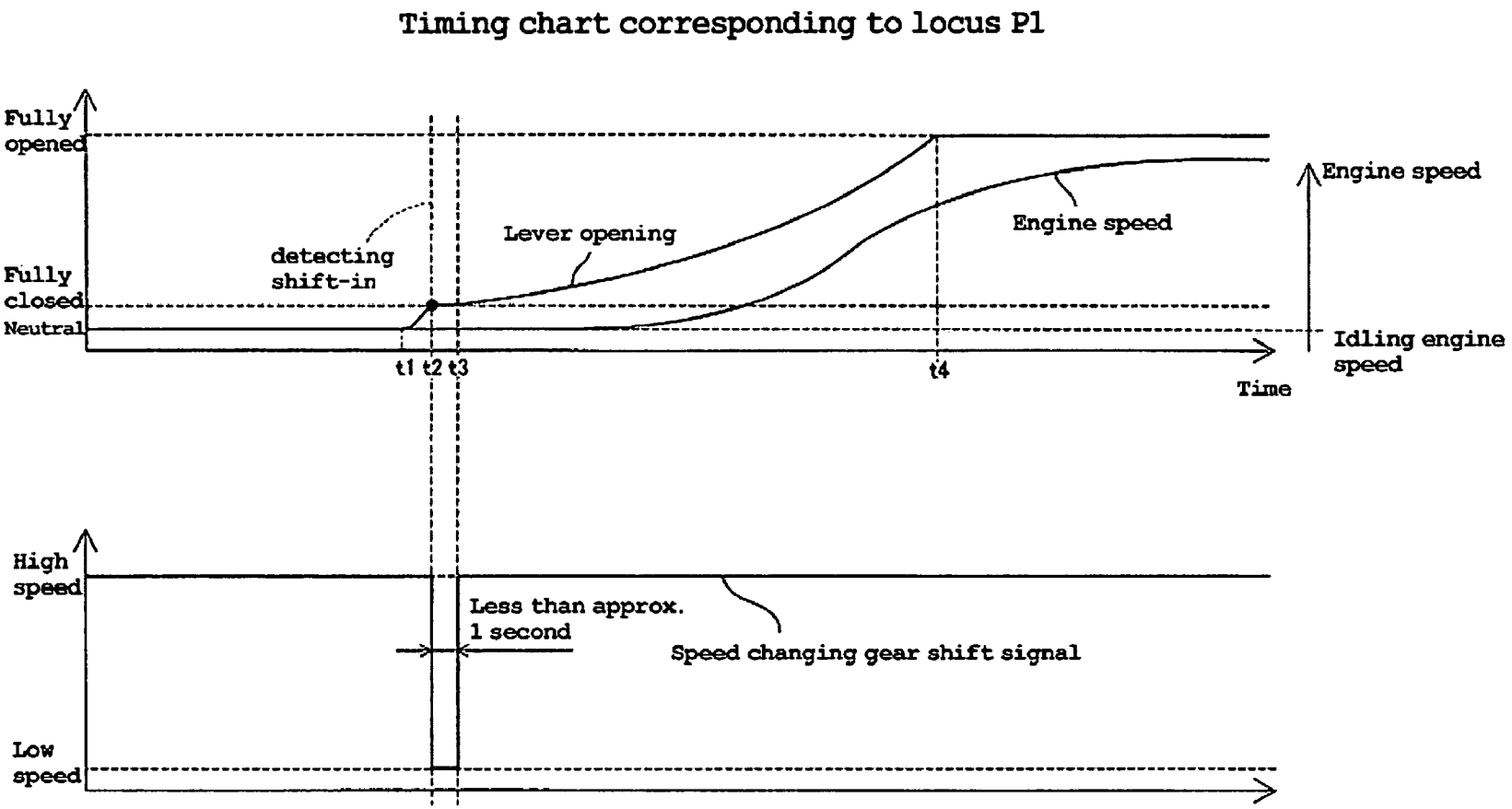
FIG. 9 is a timing chart illustrating shifting states of the transmission mechanism of the marine propulsion system in accordance with a preferred embodiment of the present invention.
Figure 10:
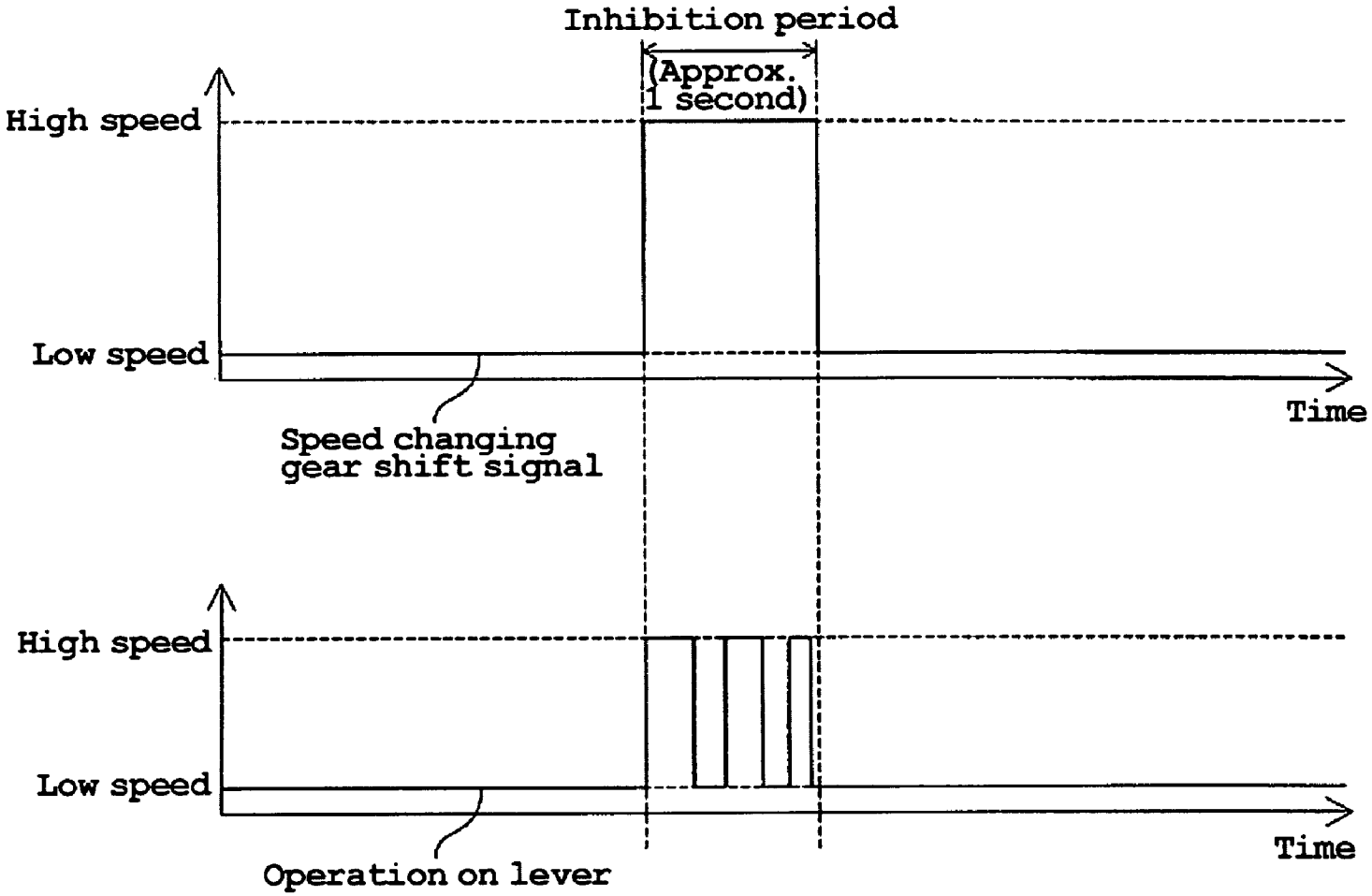
FIG. 10 is a timing chart illustrating a period in which no shift is made by the transmission mechanism of the marine propulsion system in accordance with a preferred embodiment of the present invention.

FIG. 8 is a diagram showing the transmission control map stored in the memory portion of the marine propulsion system in accordance with a preferred embodiment of the present invention. FIG. 9 is a timing chart illustrating shifting states of the transmission mechanism of the marine propulsion system in accordance with a preferred embodiment of the present invention. FIG. 10 is a timing chart illustrating a period in which a shift is not performed by the transmission mechanism of the marine propulsion system in accordance with a preferred embodiment of the present invention. Next, the transmission control map of the marine propulsion system in accordance with a preferred embodiment of the present invention will be described with reference to FIGS. 2, 3, 5, and 8 through 10.

As shown in FIG. 8, the transmission control map in accordance with a preferred embodiment is provided by the relationship between the engine speed of the engine 31 and the lever opening of the lever 5*a* of the control lever section 5. In other words, the vertical axis of the transmission control map represents the engine speed of the engine 31. The horizontal axis represents the lever opening of the lever 5*a*. The transmission control map includes a low speed range R1 providing the low speed reduction ratio, a high speed range R2 providing the high speed reduction ratio, and a dead zone range R3 provided at a boundary between the low speed range R1 and the high speed range R2. The low speed range R1, high speed range R2, and dead zone range R3 are examples of a "first range", "second range", and "third range" in a preferred embodiment of the present invention, respectively. The transmission control map in accordance with this preferred embodiment of the present invention is commonly used for both the forward travel and the rearward travel.

The dead zone range R3 of the transmission control map is provided to prevent frequent speed shifts. No shift is made between the reduction ratios in the case that a locus given by the lever opening (accelerator opening signal) based on operation on the lever 5*a* of the control lever section 5 by the user and the engine speed (engine speed signal) of the engine 31 sent from the ECU 34 is positioned in the dead zone range R3. The dead zone range R3 is provided in a band shape between a shift-down referential line D provided on a side abutting the low speed range R1 providing the low speed reduction ratio and a shift-up referential line U provided on a side abutting the high speed range R2 providing the high speed reduction ratio. In the dead zone range R3, the difference in the engine speed of the engine 31 between the shift-down referential line D and the shift-up referential line U becomes larger as the lever opening of the lever 5*a* of the control lever section 5 becomes larger. The shift-down referential line D is an example of a "first referential line", and the shift-up referential line U is an example of a "second referential line" according to a preferred embodiment of the present invention.

Specifically, the difference between the engine speed (approx. 700 rpm) of the engine 31 (see FIG. 2) of the shift-down referential line D and the engine speed (approx. 500 rpm) of the engine 31 of the shift-up referential line U at 0% of the accelerator opening in the dead zone range R3 is approximately 200 rpm. Meanwhile, the difference between the engine speed (approx. 4300 rpm) of the engine 31 of the shift-down referential line D and the engine speed (approx. 5200 rpm) of the engine 31 of the shift-up referential line U at 90% of the accelerator opening in the dead zone range R3 is approximately 900 rpm. The difference (approx. 900 rpm) in the engine speed of the engine 31 between the shift-down referential line D and the shift-up referential line U at 90% of the accelerator opening in the dead zone range R3 is larger than a decreasing magnitude of the engine speed of the engine 31 (amount of reduction in the engine speed) when the transmission mechanism 33 normally shifts from the low speed reduction ratio to the high speed reduction ratio.

In this preferred embodiment, as shown in FIG. 10, the control portion 52 does not send the speed changing gear shift signal to the ECU 34 to control the transmission mechanism 33 so as not make a shift within a inhibition period (approx. 1 second) after the transmission mechanism 33 has made a shift. In other words, the control portion 52 prevents the transmission mechanism 33 from shifting a plural number of times strictly in response to operation of the user in the case that the user repeatedly turns the lever 5*a* of the control lever section 5 in the fore-and-aft direction in the inhibition period (approx. 1 second). FIG. 10 indicates the inhibition period after a shift from the low speed reduction ratio to the high speed reduction ratio.

The control portion 52 causes the transmission mechanism 33 to shift to either of the low speed and high speed reduction ratios based on states of the engine speed (engine speed signal) of the engine 31 and the lever opening (accelerator opening signal) of the lever 5*a* on the transmission control map at an end point of the inhibition period (approx. 1 second) after a shift is made by the transmission mechanism 33. In this case, the control portion 52 performs functions to determine in which reduction ratio between the high speed and low speed reduction ratios the transmission mechanism 33 makes engagement based on the state at the end point of the inhibition period (approx. 1 second) after a shift is made by the transmission mechanism 33, and to send the speed changing gear shift signal of the reduction ratio of the determination to the ECU 34. The ECU 34 sends the electromagnetic hydraulic pressure control valve driving signal to the electromagnetic hydraulic pressure control valve 37 based on the speed changing gear shift signal determined by the control portion 52. Thereby, the transmission mechanism 33 shifts to a predetermined reduction ratio. FIG. 10 illustrates a case that a shift is made to the low speed reduction ratio at the end point of the inhibition period.

Figure 11:
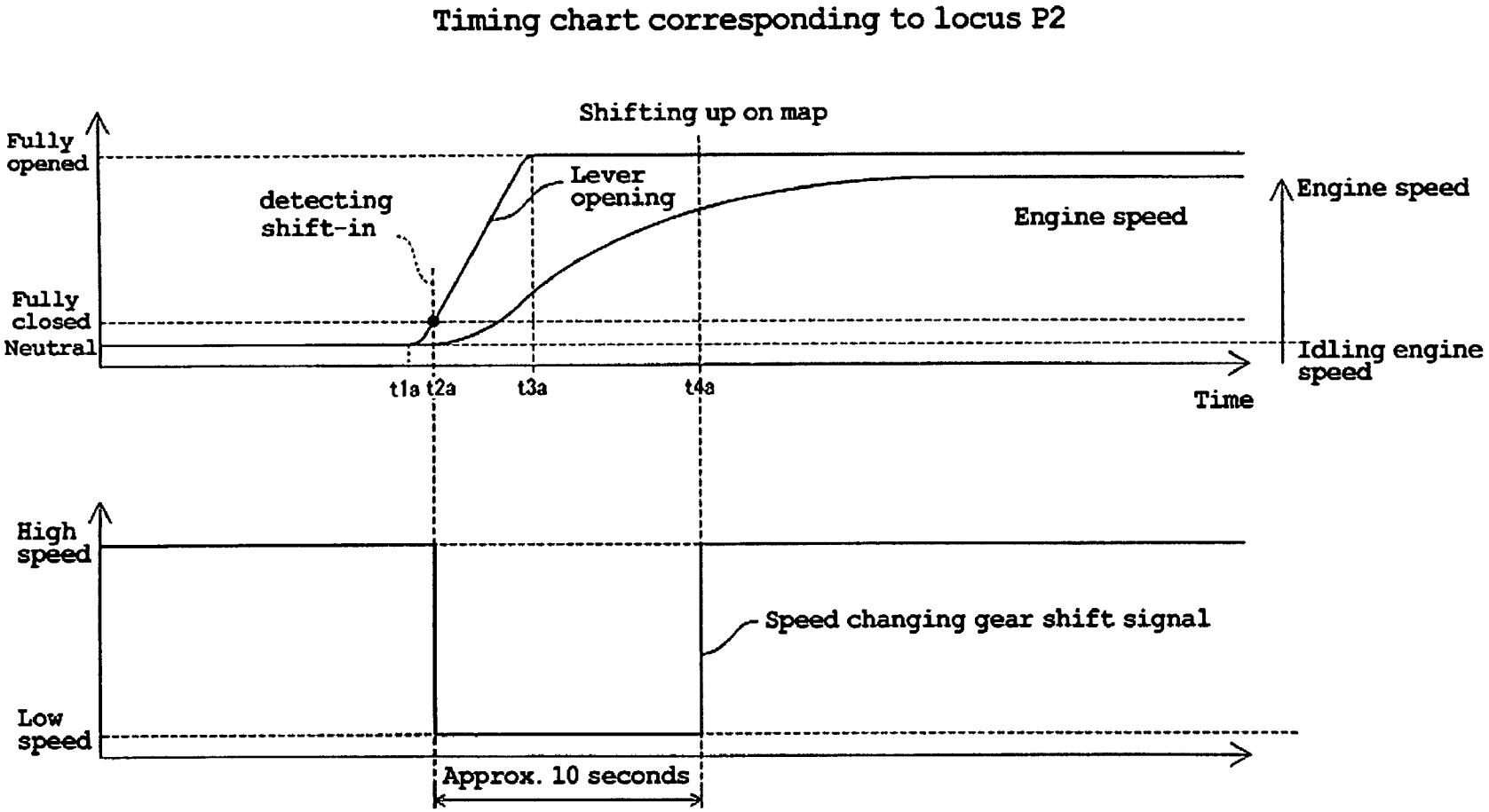
FIG. 11 is a timing chart illustrating shifting states of the transmission mechanism of the marine propulsion system in accordance with a preferred embodiment of the present invention.
Figure 12:
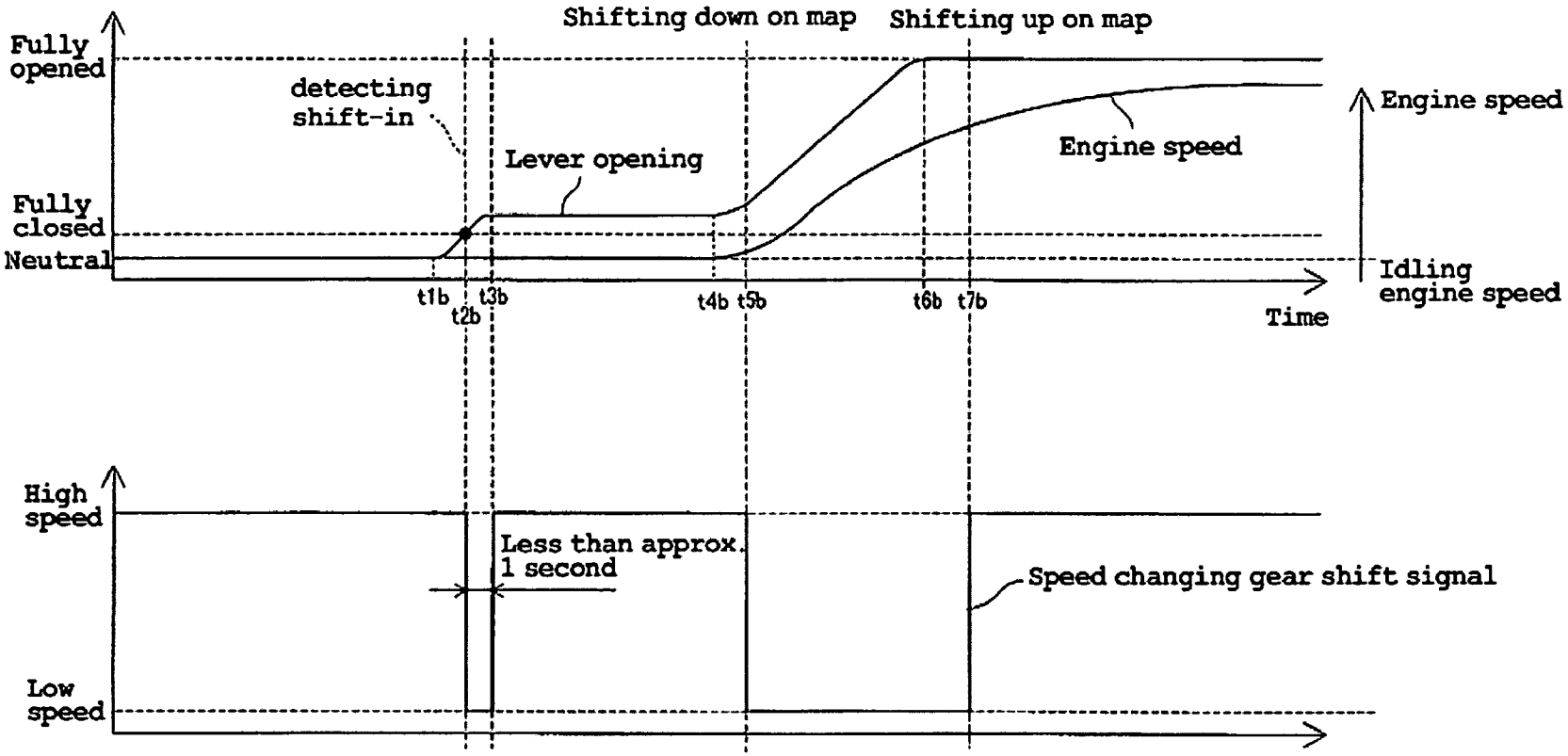
FIG. 12 is a timing chart illustrating shifting states of the transmission mechanism of a marine propulsion system in accordance with a preferred embodiment of the present invention.

FIGS. 11 and 12 are timing charts illustrating shifting states of the transmission mechanism of the marine propulsion system in accordance with this preferred embodiment of the present invention. Next, transmission operation based on the transmission control map in accordance with this preferred embodiment will be described with reference to FIGS. 3, 5, 8, 9, 11, and 12.

In this preferred embodiment, as shown in FIG. 2, the control portion 52 controls a shift between the reduction ratios of the transmission mechanism 33 based on the transmission control map (see FIG. 8) providing a reference for a shift between the reduction ratios of the transmission mechanism 33 taking into consideration the engine speed (engine speed signal) of the engine 31 and the lever opening of the lever 5*a* of the control lever 5. Specifically, the control portion 52 performs a different transmission control in response to loci P1 through P3 on the transmission control map given by the lever opening (accelerator opening signal) based on operation of the lever 5*a* of the control lever section 5 by the user and the engine speed (engine speed signal) of the engine 31 sent from the ECU 34.

First, a description will be provided of a transmission operation of the transmission mechanism 33 in the case that the user slowly turns the lever 5*a* of the control lever section 5 from the neutral position (position of the lever 5*a* drawn with solid lines in FIG. 3) to a fully opened position (position FWD2 in FIG. 3) as indicated by the locus P1 in FIG. 8. In this case, it is considered that the user has an intention of slowly accelerating the hull 2.

In this case, the following operation is performed before the lever opening enters a fully closed state indicated in FIG. 8. As shown in FIG. 9, the lever 5*a* of the control lever section 5 is turned by operation of the user from a neutral state at a time t1 to the fully closed state (position FWD1 in FIG. 3). The lever opening enters the fully closed state (at time t2). As shown in FIG. 9, the transmission mechanism 33 shifts to the low speed reduction ratio at the time t2 that the lever 5*a* is turned to position FWD1 in FIG. 3. In this case, as shown in FIG. 2, the control portion 52 sends the speed changing gear shift signal to cause the transmission mechanism 33 shift to the low speed reduction ratio to the ECU 34. The ECU 34 receives the speed changing gear shift signal and sends the electromagnetic hydraulic pressure control valve driving signal to the electromagnetic hydraulic pressure control valve 37 so that only the forward-reverse switching clutch 334 (see FIG. 5) of the lower transmission section 330 is engaged. Accordingly, the electromagnetic hydraulic pressure control valve 37 increases the pressure of the oil in the oil passage 336*c* (see FIG. 5), and thereby the piston 334*e* (see FIG. 5) slides to bring the clutch plates 334*b* (see FIG. 5) and the clutch plates 334*d* (see FIG. 5) into contact. Therefore, the forward-reverse switching clutch 334 (see FIG. 5) becomes the engaged state. As a result, the transmission mechanism 33 performs a shift in a manner such that the boat 1 can travel forward in the low speed reduction ratio.

As shown in FIG. 9, in the case that the position of the lever 5*a* is substantially retained at the fully closed position (position FWD1 in FIG. 3) from the time t2 to a time t3, the transmission mechanism 33 shifts to the high speed reduction ratio at the time t3. Specifically, as shown in FIG. 2, the control portion 52 sends the speed changing gear shift signal to cause the transmission mechanism 33 shift to the high speed reduction ratio to the ECU 34. The ECU 34 receives the speed changing gear shift signal and sends the electromagnetic hydraulic pressure control valve driving signal to the electromagnetic hydraulic pressure control valve 37 so that both the clutch 313 (see FIG. 5) of the upper transmission section 310 and the forward-reverse switching clutch 334 (see FIG. 5) of the lower transmission section 330 are engaged. Accordingly, the electromagnetic hydraulic pressure control valve 37 increases the pressure of the oil in the oil passage 316*a* (see FIG. 5), and thereby the piston 313*e* (see FIG. 5) slides to bring the clutch plates 313*b* (see FIG. 5) and the clutch plates 313*d* (see FIG. 5) into contact. Therefore, the clutch 313 (see FIG. 5) enters the engaged state. At this point, the forward-reverse switching clutch 334 is in the engaged state. Therefore, control is performed such that the forward-reverse switching clutch 334 retains the engaged state. As a result, the transmission mechanism 33 performs a shift in a manner such that the boat 1 can travel forward in the high speed reduction ratio.

Thereafter, the lever 5*a* is turned by operation of the user from the fully closed position (position FWD1 in FIG. 3) to the fully opened position (position FWD2 in FIG. 3) from the time t3 to a time t4. In this case, as shown in FIG. 8, the lever opening of the lever 5*a* and the engine speed of the engine 31 are changed as the locus P1 on the transmission control map. Since the locus P1 moves only in the high speed range R2, the transmission mechanism 33 retains the high speed reduction ratio and does not shift the reduction ratios. Thereby, the boat 1 can accelerate in the forward travel while preventing an increase in the engine speed of the engine 31. In this case, the boat 1 accelerates in a way that reflects a user's intention of accelerating slowly.

Next, description will be provided of a transmission operation of the transmission mechanism 33 in the case that the user quickly turns the lever 5*a* of the control lever section 5 from the neutral position (position of the lever 5*a* drawn with solid lines in FIG. 3) to the fully opened position (position FWD2 in FIG. 3) as indicated by the locus P2 in FIG. 8. In this case, it is considered that the user has an intention of rapidly accelerating.

In this case, the following operation is first performed before the lever opening becomes the fully closed state indicated in FIG. 8. As shown in FIG. 11, the lever 5*a* of the control lever 5 is turned by operation of the user from the neutral state at time t1*a* to the fully opened state (position FWD2 in FIG. 3). The lever opening becomes the fully opened state (at time t3*a*). The transmission mechanism 33 shifts to the low speed reduction ratio at the time t2*a* that the lever 5*a* is turned to position FWD1 in FIG. 3. As a result, the transmission mechanism 33 performs a shift in a manner such that the boat 1 can travel forward in the low speed reduction ratio. The specific descriptions for this case are similar to the case of the timing chart corresponding to the locus P1 indicated in FIG. 9 and will not be made herein.

As shown in FIG. 8, the lever opening of the lever 5*a* and the engine speed of the engine 31 change as the locus P2 on the transmission control map from the time t2*a* (see FIG. 11) to a time t4*a* (see FIG. 11). Since the locus P2 moves only in the low speed range R1 from the time t2*a* to the time t4*a*, the transmission mechanism 33 retains the low speed reduction ratio and does not shift the reduction ratios. As a result, the boat 1 can travel forward in the low speed reduction ratio, and thus the transmission mechanism 33 allows rapid acceleration of the boat 1.

Thereafter, the engine speed of the engine 31 is sufficiently increased at the time t4*a* (see FIG. 11). The locus P2 moves from the low speed range R1 and crosses the dead zone range R3 and the shift-up referential line U. Thereby, the transmission mechanism 33 shifts from the low speed reduction ratio to the high speed reduction ratio. Specifically, as shown in FIG. 2, the control portion 52 sends the speed changing gear shift signal to make the transmission mechanism 33 shift to the high speed reduction ratio to the ECU 34. The ECU 34 receives the speed changing gear shift signal and sends the electromagnetic hydraulic pressure control valve driving signal to the electromagnetic hydraulic pressure control valve 37 so that the clutch 313 (see FIG. 5) of the upper transmission section 310 is engaged. Accordingly, the electromagnetic hydraulic pressure control valve 37 increases the pressure of the oil in the oil passage 316*a* (see FIG. 5), and thereby the piston 313*e* (see FIG. 5) slides to bring the clutch plates 313*b* (see FIG. 5) and the clutch plates 313*d* (see FIG. 5) into contact. Therefore, the clutch 313 (see FIG. 5) becomes the engaged state. At this point, the forward-reverse switching clutch 334 is in the engaged state. Therefore, control is performed such that the forward-reverse switching clutch 334 retains the engaged state. As described above, a shift to the high speed reduction ratio is made after the hull 2 is rapidly accelerated in the low speed reduction ratio in the case of the locus P2. Therefore, the acceleration is generated in a way that reflects a user's intention of rapidly accelerating the hull 2.

Next, description will be provided of a transmission operation of the transmission mechanism 33 in the case that the user slowly turns the lever 5*a* of the control lever section 5 from the neutral position (position of the lever 5*a* drawn with solid lines in FIG. 3) to a position between the fully closed position (position FWD1 in FIG. 3) and the fully opened position (position FWD2 in FIG. 3) and thereafter quickly turns from the position between the fully closed and the fully opened positions to the fully opened position as indicated by the locus P3 in FIG. 8. In this case, it is considered that the user has the intention of slowly accelerating first and then rapidly accelerating the hull 2.

In this case, the following operation is preformed before the lever opening becomes the fully closed state indicated in FIG. 8. As shown in FIG. 12, the lever 5*a* of the control lever 5 is turned by operation of the user from the neutral state at a time t1*b* to the fully closed position (position FWD1 in FIG. 3). The lever opening becomes the fully closed state (at time t2*b*). As shown in FIG. 12, the transmission mechanism 33 shifts to the low speed reduction ratio at the time t2*b* that the lever 5*a* is turned to position FWD1 in FIG. 3. As a result, the transmission mechanism 33 performs a shift in a manner such that the boat 1 can travel forward in the low speed reduction ratio. The specific descriptions for this case are similar to the case of the timing chart corresponding to the locus P1 indicated in FIG. 9 and will not be made herein.

In the case that the position of the lever 5*a* is moved from the fully closed position (position FWD1 in FIG. 3) slightly toward the fully opened position from the time t2*b* to a time t3*b*, the transmission mechanism 33 shifts to the high speed reduction ratio at the time t3*b*. Thereby, the transmission mechanism 33 performs a shift in a manner such that the boat 1 can travel forward in the high speed reduction ratio. The specific descriptions for this case are similar to the case of the timing chart corresponding to the locus P1 indicated in FIG. 9 and will not be made herein.

Thereafter, the position of the lever 5*a* is retained at a position on the fully closed position side between the fully closed and the fully opened positions from the time t3*b* to a time t4*b*. In this case, as shown in FIG. 8, the lever opening of the lever 5*a* and the engine speed of the engine 31 are changed along the locus P3 on the transmission control map. Since the locus P3 moves only in the high speed range R2 from the time t3*b* to a time t5*b*, the transmission mechanism 33 retains the high speed reduction ratio and does not shift the reduction ratios. Accordingly, the hull 2 slowly accelerates in this state.

As shown in FIG. 12, the position of the lever 5*a* is quickly turned by operation of the user from the position between the fully closed position (position FWD1 in FIG. 3) and the fully opened position (position FWD2 in FIG. 3) to the fully opened position from the time t4*b* to a time t6*b*. In this case, as shown in FIG. 8, the locus P3 moves from the high speed range R2 and crosses the dead zone range R3 and the shift-down referential line D at the time t5*b*. Thereby, the transmission mechanism 33 shifts from the high speed reduction ratio to the low speed reduction ratio. Specifically, as shown in FIG. 2, the control portion 52 sends the speed changing gear shift signal to cause the transmission mechanism 33 shift to the low speed reduction ratio to the ECU 34. The ECU 34 receives the speed changing gear shift signal and sends the electromagnetic hydraulic pressure control valve driving signal to the electromagnetic hydraulic pressure control valve 37 so that the clutch 313 (see FIG. 5) of the upper transmission section 310 is disengaged. Accordingly, the electromagnetic hydraulic pressure control valve 37 reduces the pressure of the oil in the oil passage 316*a* (see FIG. 5), and thereby the piston 313*e* (see FIG. 5) slides to separate the clutch plates 313*b* (see FIG. 5) from the clutch plates 313*d* (see FIG. 5). Therefore, the clutch 313 (see FIG. 5) becomes the disengaged state. At this point, the forward-reverse switching clutch 334 is in the engaged state. Therefore, control is performed so that the forward-reverse switching clutch 334 retains the engaged state. As a result, the transmission mechanism 33 performs a shift so that the boat 1 can travel forward in the low speed reduction ratio, thus allowing rapid acceleration of the boat 1.

Thereafter, the engine speed of the engine 31 is sufficiently increased at a time t7*b*. The locus P3 moves from the low speed range R1 and crosses the dead zone range R3 and the shift-up referential line U. Thereby, the transmission mechanism 33 shifts from the low speed reduction ratio to the high speed reduction ratio. As a result, the transmission mechanism 33 performs a shift in a manner such that the boat 1 can travel forward in the high speed reduction ratio. The specific descriptions for this case are similar to the case of the timing chart corresponding to the locus P1 indicated in FIG. 9, and will not be made. As described above, in the case of the locus P3, the hull 2 slowly accelerates in the high speed reduction ratio and rapidly accelerates in the low speed reduction ratio. Therefore, acceleration is generated in a way that reflects a user's intention to slowly accelerate first and then rapidly accelerate the hull 2.

In this preferred embodiment, as in the foregoing descriptions, it is provided with the transmission mechanism 33 that can transmit the driving force generated by the engine 31 to the propellers 32*a* and 32*b* with the speed shifted to at least the low speed reduction ratio and the high speed reduction ratio. As described above, the transmission mechanism 33 is arranged such that the driving force generated by the engine 31 can be transmitted to the propellers 32*a* and 32*b* with the speed shifted to the low speed reduction ratio. Accordingly, acceleration performance in the low speed position can be improved. Further, the transmission mechanism 33 is arranged such that the driving force generated by the engine 31 can be transmitted to the propellers 32*a* and 32*b* with the speed shifted to the high speed reduction ratio. This allows a larger maximum speed to be achieved. As a result, both the acceleration performance and the maximum speed meet and satisfy levels that the user desires.

In this preferred embodiment, the control portion 52 controls a shift between the reduction ratios of the transmission mechanism 33 based on the transmission control map providing the reference for a shift between the reduction ratios of the transmission mechanism 33 taking into consideration the engine speed (engine speed signal) of the engine 31 and the lever opening (accelerator opening signal) of the lever 5*a* of the control lever section 5. Thereby, the transmission mechanism 33 can be controlled so that it shifts to the low speed reduction ratio to increase the engine speed of the engine 31 when the engine speed of the engine 31 is low compared to the lever opening of the lever 5*a* operated by the user. In other words, in the case that the user suddenly increases the lever opening of the lever 5*a* of the control level section 5 with the intention of rapid acceleration, the reduction ratio of the transmission mechanism 33 shifts to the low speed reduction ratio to improve the acceleration performance, thereby allowing quick increase in the propeller speeds of the propeller 32*a* and 32*b*. Accordingly, acceleration of the boat 1 (the hull 2) can be generated in response to the intent of the user. The transmission mechanism 33 can be controlled so that it shifts to the high speed reduction ratio to slowly increase the propeller speeds of the propeller 32*a* and 32*b* in the case that the user slowly increases the lever opening of the lever 5*a* of the control lever section 5 with the intention of slow acceleration. Accordingly, increase in the engine speed of the engine 31 can be prevented, thus allowing prevention of fuel consumption by the engine 31.

In this preferred embodiment, as described above, the control portion 52 performs control for a shift to the low speed reduction ratio in the case that the locus P3 on the transmission control map given by the lever opening based on operation of the lever 5*a* of the control lever 5 by the user and the engine speed of the engine 31 enters the low speed range R1 from the high speed range R2 via the dead zone range R3 on the transmission control map. Accordingly, the engine speed of the engine 31 can be additionally increased compared to a case that the transmission mechanism 33 retains the high speed reduction ratio. This allows a decrease in traveling acceleration to be prevented.

In this preferred embodiment, as described above, the control portion 52 performs control for a shift to the high speed reduction ratio in the case that the locus P2 or P3 on the transmission control map given by the lever opening based on operation of the lever 5*a* of the control lever 5 by the user and the engine speed of the engine 31 enters the high speed range R2 from the low speed range R1 via the dead zone range R3 on the transmission control map. Thereby, the maximum speed of the boat 1 can be improved compared to the case that the transmission mechanism 33 retains the low speed reduction ratio.

In this preferred embodiment, as described above, the control portion 52 performs control so that the transmission mechanism 33 performs no shift in the case that a locus given by the lever opening of the lever 5*a* of the control lever section 5 and the engine speed of the engine 31 is positioned in the band-shaped dead zone range R3. The band-shaped dead zone range R3 is provided between the low speed range R1 and the high speed range R2 as described above. Therefore, the transmission mechanism 33 does not shift from the low speed reduction ratio to the high speed reduction ratio only because the locus given by the lever opening of the lever 5*a* and the engine speed of the engine 31 slightly moves from the low speed range R1 toward the high speed range R2. Further, the transmission mechanism 33 does not shift from the high speed reduction ratio to the low speed reduction ratio when the locus given by the lever opening of the lever 5*a* and the engine speed of the engine 31 slightly moves from the high speed range R2 toward the low speed range R1. In other words, the transmission mechanism 33 can be prevented from immediately shifting in the case that the locus given by the lever opening of the lever 5*a* and the engine speed of the engine 31 goes off from either the low speed range R1 or the high speed range R2.

In this preferred embodiment, as described above, the control portion 52 controls a shift in the transmission mechanism 33 to the low speed reduction ratio in the case that the locus on the transmission control map given by the lever opening of the lever 5*a* of the control lever section 5 and the engine speed of the engine 31 enters the low speed range R1 providing the low speed reduction ratio by crossing the shift-down referential line D of the dead zone range R3. This facilitates a shift of the transmission mechanism 33 to the low speed reduction ratio based on the transmission control map. The control portion 52 controls a shift in the transmission mechanism 33 to the high speed reduction ratio in the case that the locus on the transmission control map given by the lever opening of the lever 5*a* of the control lever section 5 and the engine speed of the engine 31 enters the high speed range R2 providing the high speed reduction ratio by crossing the shift-up referential line U of the dead zone range R3. This facilitates a shift of the transmission mechanism 33 to the high speed reduction ratio based on the transmission control map.

In this preferred embodiment, as described above, the difference in the engine speed of the engine 31 between the shift-down referential line D and the shift-up referential line U of the dead zone range R3 is larger than the magnitude of the engine speed of the engine 31 decreasing when the transmission mechanism 33 shifts from the low speed reduction ratio to the high speed reduction ratio. Thereby, the transmission mechanism 33 can be prevented from again shifting back to the low speed reduction ratio after a shift to the high speed reduction ratio because the locus of the engine speed falls below the shift-down referential line D due to decrease in the engine speed of the engine 31 in a shift from the low speed reduction ratio to the high speed reduction ratio.

In this preferred embodiment, as described above, the dead zone range R3 is set so that the difference in the engine speed of the engine 31 between the shift-down referential line D and the shift-up referential line U becomes larger as the lever opening of the lever 5*a* of the control lever section 5 becomes larger. This allows a prevention of the engine speed of the engine 31 from exceeding a width of the engine speed of the dead zone range R3 in a section for the large lever opening (accelerator opening) on the transmission control map in which the engine speed of the engine 31 is apt to largely change.

In this preferred embodiment, as described above, the control portion 52 performs control to shift temporarily (for approx. 1 second) to the low speed reduction ratio and thereafter to the high speed reduction ratio when the transmission mechanism 33 shifts from the neutral state to the high speed reduction ratio based on operation of the lever 5*a* of the control lever section 5 by the user. Thereby, a shift shock in shifting can be prevented since a shift is made (gear positions are changed) from the neutral position in a state that the engine 31 rotates at a low engine speed.

In this preferred embodiment, as described above, the control portion 52 and the ECU 34 control the transmission mechanism 33 so that it does not shift in the inhibition period (approx. 1 second) after it has made a shift. Accordingly, in the case that the user repeatedly turns the lever 5*a* in the fore-and-aft direction in a short period (for example, approx. 1 second), the transmission mechanism 33 can be prevented from shifting in response to movements of the lever 5*a*.

In this preferred embodiment, as described above, the control portion 52 and the ECU 34 control the transmission mechanism 33 so that it makes an engagement in either of the low speed reduction ratio and the high speed reduction ratio based on a state of the engine speed of the engine 31 and the lever opening of the lever 5*a* of the control lever section 5 on the transmission control map at the end point of the predetermined period (approx. 1 second). Thereby, the transmission mechanism 33 performs a shift to the reduction ratio desired by the user in the end point of the predetermined period (approx. 1 second).

In this preferred embodiment, as described above, the common LAN cable 7 arranged to permit communication between the control portion 52 and the ECU 34 and the common LAN cable 8 are preferably provided independently. Thereby, communication signals between the control portion 52 and the ECU 34 can be allotted to them. This allows a prevention of saturation of data capacity transmitted through the cables differently from the case that one cable is provided for communication between the control portion 52 and the ECU 34. Thereby, in the event that trouble occurs with either of the common LAN cables 7 and 8, data communication minimally necessary for travel of the boat 1 can be performed with use of either other cable of the common LAN cables 7 and 8.

In this preferred embodiment, as described above, the memory portion 51 in which the transmission control map is stored is provided. This facilitates obtainment of the marine propulsion system including the transmission control map.

It should be understood that the preferred embodiments disclosed above are exemplary cases and do not limit the present invention. It is intended that the scope of the present invention be defined not by the preferred embodiments discussed above but solely by the appended claims. Further, the present invention includes all modifications within meanings equivalent to the claims and the scope thereof.

For example, in the above preferred embodiments, descriptions are provided about the marine propulsion system preferably including the two outboard motors in which the engine and the propellers are disposed outside of the hull as an exemplary case. However, the present invention is not limited to this case, but can be applied to other marine propulsion systems including an in board motor in which an engine and a propeller are fixed to a hull. The present invention can be applied to a marine propulsion system including a single outboard motor.

In the above preferred embodiments, descriptions are provided about the marine propulsion system including the outboard motor having the two propellers as an exemplary case. However, the present invention is not limited to this case, but can be applied to other marine propulsion systems including an outboard motor having a single, three, or more propellers.

In the above preferred embodiments, descriptions are provided about a case that the transmission control map for the reverse travel of the boat has a configuration similar to the transmission control map for the forward travel of the boat.

However, the present invention is not limited to this case. Two transmission control maps, in which one is dedicated to the forward travel and the other is dedicated to the reverse travel may be provided.

In the above preferred embodiments, descriptions are provided about a case in which the control portion and the ECU are connected together by the common LAN cables and thereby communication can be performed. However, the present invention is not limited to this case. Communication between the control portion and the ECU may be realized by wireless communication.

In the above preferred embodiments, the shift position signal is transmitted from the control portion to the ECU via only the common LAN cable 7. The accelerator opening signal is transmitted from the control portion to the ECU via only the common LAN cable 8. However, the present invention is not limited to this case. Both the shift position signal and the accelerator opening signal may be transmitted from the control portion to the ECU by the same common LAN cable. Further, the shift position signal may be transmitted from the control portion to the ECU via only the common LAN cable 8. The accelerator opening signal may be transmitted from the control portion to the ECU via only the common LAN cable 7.

In the above preferred embodiments, the rotational speed of the crankshaft is used as an example of the engine speed. However, the present invention is not limited to this case. For example, the rotational speeds of members (shafts) other than the crankshaft that rotate together with rotation of the crankshaft in the engine such as propeller and output shaft may be used as the engine speed.

In the above preferred embodiments, descriptions are provided about a case that the lever 5*a* of the control lever section 5 is operated and thereby the accelerator opening, the reduction ratios of the transmission mechanism 33, and so forth are electrically (by electronic control) controlled. However, the present invention is not limited to this case. For example, a wire may be connected to the lever 5*a*. The opening of the lever 5*a* may be mechanically transmitted to the outboard motor 3 as the operation amount and the operating direction, and thereby controlling the accelerator opening and the reduction ratio of the transmission mechanism 33. In this case, the operation amount and the operating direction of the wire are converted into an electric signal between the lever 5*a* and the ECU 34 in the outboard motor 3. The converted signal is transmitted to the ECU 34. Further, in this case, the transmission control map is stored in the ECU 34 provided in the outboard motor 3. A control signal arranged to control the transmission mechanism 33 (e.g., electromagnetic hydraulic pressure control valve driving signal) is output from the ECU 34.

In the above preferred embodiments, descriptions are provided about a case that the transmission control map is stored in the memory portion 51 included in the control lever section 5 and the control signal arranged to make the transmission mechanism 33 shift the reduction ratios is output from the control portion 52 included in the control lever section 5. However, the present invention is not limited to this case. The transmission control map may be stored in the ECU 34 provided in the outboard motor 3. In this case, the control signal may be output from the ECU 34 in which the transmission control map is stored. Further, in this case, an ECU other than the ECU 34 controlling the engine may be provided in the outboard motor. The transmission control map may be stored in the ECU. The control signal may be output from the ECU. This modification can be applied to a construction that the accelerator opening and the reduction ratio of the transmission mechanism 33 are mechanically controlled by the lever 5*a* of the control lever section 5 with use of the wire as described above.

In the above preferred embodiments, descriptions are provided about a case that the shift between forward, neutral, and reverse is performed by the electrically controlled lower transmission section 330. However, the present invention is not limited to this case. The shift between forward, neutral, and reverse may be performed by a forward-reverse switching mechanism arranged with a pair of bevel gear and dog clutch as in an outboard motor disclosed in JP-A-Hei 9-263294.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A marine propulsion system comprising:

an engine;

a propeller driven by the engine;

a transmission mechanism that operates in at least a lower speed reduction ratio and a higher speed reduction ratio, and transmits a driving force generated by the engine to the propeller with a speed thereof shifted to one of the lower speed reduction ratio and the higher speed reduction ratio;

a control lever section operated by a user to control a drive of the engine; and a control portion that controls a shift between the lower speed reduction ratio and the higher speed reduction ratio of the transmission mechanism based on operation of the control lever section by the user; wherein the control portion controls a shift between the lower speed reduction ratio and the higher speed reduction ratio of the transmission mechanism based on a transmission control map which provides a reference for a shift between the lower speed reduction ratio and the higher speed reduction ratio of the transmission mechanism based on an engine speed and a lever opening of the control lever section; and the control portion includes:

a first control section provided in the control lever section;

a second control section provided in the engine;

a first communication line communicating between the first control section and the second control section; and a second communication line provided independently of the first communication line communicating between the first control section and the second control section.

2. The marine propulsion system according to claim 1, wherein the transmission control map includes a first range providing the lower speed reduction ratio, a second range providing the higher speed reduction ratio, and a third range provided between the first range and the second range; and the control portion controls a shift to the lower speed reduction ratio when a locus on the transmission control map given by an amount of the lever opening based on operation of the control lever section by the user and the engine speed enters the first range from the second range of the transmission control map through the third range.

3. The marine propulsion system according to claim 2, wherein the control portion controls a shift to the higher speed reduction ratio in a case that a locus on the transmission control map given by the lever opening based on operation of the control lever section by the user and the engine speed enters the second range from the first range through the third range of the transmission control map.

4. The marine propulsion system according to claim 2, wherein the third range of the transmission control map has a band shape between a first referential line provided on a side abutting the first range providing the lower speed reduction ratio and a second referential line provided on a side abutting the second range providing the higher speed reduction ratio; and the control portion controls the transmission mechanism so that the transmission mechanism does not perform a shift when the lever opening of the control lever section and the engine speed are positioned in the band-shaped third range.

5. The marine propulsion system according to claim 4, wherein the control portion controls the transmission mechanism so that the transmission mechanism shifts to the lower speed reduction ratio when the locus, given by the lever opening position of the control lever section and the engine speed, enters the first range providing the lower speed reduction ratio by crossing the first referential line of the third range on the transmission control map, and controls the transmission mechanism so that the transmission mechanism shifts to the higher speed reduction ratio in a case that the locus, given by the lever opening of the control lever section and the engine speed, enters the second range providing the higher speed reduction ratio by crossing the second referential line of the third range.

6. The marine propulsion system according to claim 1, wherein the control portion controls the transmission mechanism so that the transmission mechanism does not shift in a certain period after the transmission mechanism performs a shift.

7. The marine propulsion system according to claim 1, further comprising a memory portion in which the transmission control map is stored.

8. A marine propulsion system comprising:

an engine;

a propeller driven by the engine;

a transmission mechanism that operates in at least a lower speed reduction ratio and a higher speed reduction ratio, and transmits a driving force generated by the engine to the propeller with a speed thereof shifted to one of the lower speed reduction ratio and the higher speed reduction ratio;

a control lever section operated by a user to control a drive of the engine; and a control portion that controls a shift between the lower speed reduction ratio and the higher speed reduction ratio of the transmission mechanism based on operation of the control lever section by the user; wherein the control portion controls a shift between the lower speed reduction ratio and the higher speed reduction ratio of the transmission mechanism based on a transmission control map which provides a reference for a shift between the lower speed reduction ratio and the higher speed reduction ratio of the transmission mechanism based on an engine speed and a lever opening of the control lever section;

the transmission control map includes a first range providing the lower speed reduction ratio, a second range providing the higher speed reduction ratio, and a third range provided between the first range and the second range;

the control portion controls a shift to the lower speed reduction ratio when a locus on the transmission control map given by an amount of the lever opening based on operation of the control lever section by the user and the engine speed enters the first range from the second range of the transmission control map through the third range;

the third range of the transmission control map has a band shape between a first referential line provided on a side abutting the first range providing the lower speed reduction ratio and a second referential line provided on a side abutting the second range providing the higher speed reduction ratio;

the control portion controls the transmission mechanism so that the transmission mechanism does not perform a shift when the lever opening of the control lever section and the engine speed are positioned in the band-shaped third range; and a difference in the engine speed between the first and the second referential lines becomes larger as the lever opening position of the control lever section becomes larger in the third range of the transmission control map.

9. The marine propulsion system according to claim 8, wherein the difference in the engine speed between the first and the second referential lines is larger than a magnitude of the engine speed decreasing when a shift is performed by the transmission mechanism from the lower speed reduction ratio to the higher speed reduction ratio.

10. A marine propulsion system comprising:

an engine;

a propeller driven by the engine;

a transmission mechanism that operates in at least a lower speed reduction ratio and a higher speed reduction ratio, and transmits a driving force generated by the engine to the propeller with a speed thereof shifted to one of the lower speed reduction ratio and the higher speed reduction ratio;

a control lever section operated by a user to control a drive of the engine; and a control portion that controls a shift between the lower speed reduction ratio and the higher speed reduction ratio of the transmission mechanism based on operation of the control lever section by the user; wherein the control portion controls a shift between the lower speed reduction ratio and the higher speed reduction ratio of the transmission mechanism based on a transmission control map which provides a reference for a shift between the lower speed reduction ratio and the higher speed reduction ratio of the transmission mechanism based on an engine speed and a lever opening of the control lever section;

the control portion controls the transmission mechanism so that the transmission mechanism temporarily shifts to the lower speed reduction ratio and thereafter shifts to the higher speed reduction ratio when the transmission mechanism shifts from a neutral position to the higher speed reduction ratio based on operation of the control lever section by the user.

11. A marine propulsion system comprising:

an engine;

a propeller driven by the engine;

a transmission mechanism that operates in at least a lower speed reduction ratio and a higher speed reduction ratio, and transmits a driving force generated by the engine to the propeller with a speed thereof shifted to one of the lower speed reduction ratio and the higher speed reduction ratio;

a control lever section operated by a user to control a drive of the engine; and a control portion that controls a shift between the lower speed reduction ratio and the higher speed reduction ratio of the transmission mechanism based on operation of the control lever section by the user; wherein the control portion controls a shift between the lower speed reduction ratio and the higher speed reduction ratio of the transmission mechanism based on a transmission control map which provides a reference for a shift between the lower speed reduction ratio and the higher speed reduction ratio of the transmission mechanism based on an engine speed and a lever opening of the control lever section;

the control portion controls the transmission mechanism so that the transmission mechanism does not shift in a certain period after the transmission mechanism performs a shift; and the control portion controls the transmission mechanism such that the transmission mechanism is engaged in either of the lower speed reduction ratio or the higher speed reduction ratio based on a state of the engine speed and the lever opening of the control lever section on the transmission control map at an end point of the certain period.

* * * * *